United States Patent [19]

Maruyama et al.

[11] Patent Number: 4,937,629

[45] Date of Patent: Jun. 26, 1990

[54] COMOSITE IMAGE RECORDING APPARATUS

[75] Inventors: Kazuo Maruyama; Kiyoshi Horie; Tsuneo Naomi, all of Kanagawa; Toshiro Yamamoto, Tokyo; Koji Adachi, Kanagawa; Toru Okamoto, Kanagawa; Takeshi Sumikawa, Kanagawa; Nobumasa Furuya, Kanagawa, all of Japan

[73] Assignee: Fuji Xerox Co., Ltd., Tokyo, Japan

[21] Appl. No.: 230,745

[22] Filed: Aug. 10, 1988

Related U.S. Application Data

[63] Continuation-in-part of Ser. No. 121,807, Nov. 7, 1987, Pat. No. 4,882,247.

[30] Foreign Application Priority Data

| | | | |
|---|---|---|---|
| Nov. 18, 1986 | [JP] | Japan | 61-272790 |
| Dec. 4, 1986 | [JP] | Japan | 61-287809 |
| Jan. 23, 1987 | [JP] | Japan | 62-12234 |
| Apr. 13, 1987 | [JP] | Japan | 62-88626 |
| Apr. 13, 1987 | [JP] | Japan | 62-8628 |
| Jun. 10, 1987 | [JP] | Japan | 62-143301 |
| Aug. 10, 1987 | [JP] | Japan | 62-198300 |
| Feb. 15, 1988 | [JP] | Japan | 63-30816 |
| Jun. 7, 1988 | [JP] | Japan | 63-138399 |

[51] Int. Cl.[5] ..... G03G 15/08; G03G 13/01

[52] U.S. Cl. ..... 355/265; 355/244; 355/246; 430/45

[58] Field of Search ..... 355/265, 267, 246, 245, 355/244, 326; 430/45, 54, 124, 108, 137

[56] References Cited

U.S. PATENT DOCUMENTS

| | | | |
|---|---|---|---|
| 4,124,385 | 11/1978 | O'Horo | 96/1 SD |
| 4,238,558 | 12/1980 | Ziolo | 430/108 |
| 4,245,026 | 1/1981 | Ziolo | 430/137 |
| 4,416,533 | 11/1983 | Tokunaga et al. | 355/326 X |
| 4,539,281 | 9/1985 | Tanaka et al. | 430/45 |
| 4,611,901 | 9/1986 | Kohyama et al. | 355/326 X |

FOREIGN PATENT DOCUMENTS

| | | |
|---|---|---|
| 66141 | 12/1982 | European Pat. Off. . |
| 142731 | 5/1985 | European Pat. Off. . |
| 55-137538 | 10/1980 | Japan . |
| 57-2047 | 1/1982 | Japan . |
| 60-126665 | 7/1985 | Japan . |
| 1586193 | 3/1981 | United Kingdom . |

*Primary Examiner*—A. C. Prescott

*Attorney, Agent, or Firm*—Finnegan, Henderson, Farabow, Garrett and Dunner

[57] ABSTRACT

An image forming method of the present invention comprises: a first toner image formation process for forming a first toner image by forming, on a latent image carrier, a first latent image which corresponds to a first image and developing the first latent image by a first toner charged to one polarity through a development process selected from normal and reverse development process selected from normal and reverse development processes so as to correspond to the polarity of the first toner; a second toner image formation process for forming a second toner image by forming, on the latent image carrier, a second latent image which correspond to a second image and developing the second latent image by a second toner charged to the other polarity by the other development process while applying a developing bias; and a transfer treatment process for simultaneously transferring said first and second toner images to a transfer medium; wherein said developing bias VB2 satisfies the following equations:

$$|VT1-VB2| > |VH2-VB2| \quad \ldots (1)$$

$$|VT1-VB2| > |VT1-VH2| \quad \ldots (2)$$

where a surface potential of said first toner image is VT1, a background potential in said second toner image forming process is VH2, and the developing bias in said second toner image forming process is VB2.

9 Claims, 28 Drawing Sheets

COMOSITE IMAGE RECORDING APPARATUS

CROSS REFERENCE TO RELATED APPLICATIONS

This application is a continuation-in-part of Application Serial No. 07/121,807, "Image Recording Method," filed Nov. 7, 1987 now U.S. Pat. No. 4,882,247.

BACKGROUND OF THE INVENTION

I. Field of the Invention

The present invention relates to a method for recording images or pictures by using electrostatic latent images, and particularly to a picture recording method and apparatus for obtaining a toner image by developing, without disturbance, a visualized image (toner image) formed previously on a latent image carrier.

II. Description of the Related Art

Various color image recording methods utilizing electronic photography methods have been proposed. An example of one such color picture recording method is a "repeated developing" method. The repeated developing method produces a color picture using a process whereby electrostatic latent images of two or three levels are formed on a single photosensitive medium. The first latent image of the photosensitive medium has latent images of two or three levels and is developed by a first developing device, thereafter the second latent image on the photosensitive medium is developed by a second developing device and then a finally formed toner image is transferred at a single time. This method is very effective in reducing size and obtaining a high copying speed.

However, in such a repeated developing method, the photosensitive medium carrying the toner image through the first developing process is then rubbed by the developer in the second and successive processes, and the toner image formed by the first developing process is disturbed by the later developing processes. As a result, this method is accompanied by the problem that the color picture finally obtained is considerably flawed. Therefore, there is a need for a picture forming method using a repeated developing method to develop successive images that does not disturb toner images of preceding images.

It is advantageous to develop successive images with a single-element no-contact development process in order not to disturb the toner image on the photosensitive medium. However, the single-element no-contact development method has problems with high speed operation. It is, therefore, preferable to use a double-element developer consisting of a carrier and toner.

However, in this case, if the magnetic brush developing method is used, developing is done by depositing the double-element developer on a non- magnetic sleeve having a magnetic roller therein and rubbing a latent image with a magnetic brush. Therefore, where the magnetic brush developing method is used, the toner image formed while developing the preceding image is disturbed because the toner image is rubbed with the tip of the magnetic brush while developing subsequent images.

As a means for solving such problems, Japanese Patent Application Unexamined Publication No. 126665/1985 proposes a color image developing device which uses a double-element developer, mixing a magnetic carrier having a grain size of 50 micrometers (μm) or less with the toner particles. A reduction in grain size of the carrier improves the effects of disturbance of the image, but when the grain size becomes smaller, more carrier transfers to the surface of the photosensitive medium from the developing device, resulting in a distinctive carry-over phenomenon. In order to avoid the carry-over phenomenon, the magnetic force must be enhanced. Accordingly, it is necessary to make the grain size of the carrier particle large. Therefore, regulating only the carrier grain size cannot result in sufficiently satisfactory results.

Various image forming methods to easily form and record composite pictures, by utilizing electronic photography methods, have been proposed. The "repeated negative exposing method" is typical of such a method using a single developing device. In this method, after the photosensitive medium of the electronic photography device is uniformly charged, a latent image of a first picture is negatively written on the photosensitive medium by the exposing means. A latent image of second picture is also formed by the negative writing method to combine the second picture with the first picture. The first and second latent images are inverted to form the composite picture.

Representative of composite picture forming methods using two developing devices is a method to form a combined picture by charging, exposing a first negative (or positive) image, exposing a second positive (or negative) image, a first developing (regular developing or inverse developing) process, and a second developing (inverse developing or regular developing) process.

Moreover, the Japanese Patent Application Unexamined Publication No. 2047/1982 discloses a method utilizing an image forming process consisting of charging, exposing a first negative image, a first developing (inverse developing) process, exposing a second positive image, and a second developing (regular developing) process.

The repeated negative image exposing method is certainly simplified in structure but has a disadvantage that the pictures cannot be combined on an ordinary positive document.

The present invention is proposed to resolve the above problems. It is therefore an object of the present invention to provide a method of recording images which develop images without disturbing the existing toner image, even if a double-element developer is used.

It is also an object of the present invention to provide a color image recording method which uses a double-element developer and which develops images without disturbing the existing toner image.

It is also an object of the present invention to provide a picture recording method which can combine pictures to a positive document, ensure good reproducibility of low concentration pictures, eliminate disturbance of the image formed by the first developing process, and prevent picture quality from being gradually deteriorated.

An important teaching of the present invention is that the density of the carrier used in the double-element developer is an important factor relating to the disturbance of the toner image when used in a magnetic brush developing device utilizing a double-element developer.

SUMMARY OF THE INVENTION

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

To achieve the foregoing objects, and in accordance with the purposes of the invention as embodied and broadly described herein, an image recording method is provided, comprising the steps of: forming an electrostatic latent image on a latent image carrier; developing the formed electrostatic latent image with toner to form a visualized toner image, a plurality of times; and transferring the visualized toner image to a transfer material, wherein a double-element developer formed from mixing toner and a magnetic carrier having a density of 4.0 g/cm$^3$ or less is used in at least the second and subsequent developing steps.

Any carrier having a density of 4.0 g/cm$^3$ or less may be used in the present invention. For example, a carrier having a porous surface, a ferrite carrier or a carrier in which the magnetic powder is dispersed into a resin binder may be used. (It is, of course, required that these carriers should have a density of 4.0 g/cm$^3$ or less.) The carrier obtained by dispersing magnetic powder into a resin binder is preferred because the density can easily be controlled by controlling the content of magnetic powder. Empirically, it has become obvious that if the density $\rho$ is in the range of from 1.7 to 4.0 g/cm$^3$, and preferably in the range of from 1.7 to 3.0 g/cm$^3$, image disturbance and the carry-over phenomenon can be controlled within an acceptable range. It can be estimated from the fact that the magnetic brush or tip part formed becomes soft since each carrier has a small density.

The density $\rho$ of the carrier used in the present invention can be determined by the density obtained using the true specific gravity measured by the following method.

In the so-called pycnometer method (true specific gravity bottle method) where the spaces of powder are completely replaced with liquid, the true specific gravity is obtained by substituting the relation between weight and volume in the following equation. The true specific gravity is obtained from the following equation by using an "auto-true denser MAT-5000" (developed by Seishin Corp.) for an automatic pycnometer method.

$$Pd = Ld \times (Wb - Wa) / (Wb - Wa - Wc + Wd),$$

where

Pd: true specific gravity;
Ld: specific gravity of liquid;
Wa: cell tare (vacant cell) (g);
Wb: cell tare +powder (g);
Wc: cell tare +powder +liquid (after determination of liquid surface) (g);
Wd: cell tare +liquid (after determination of liquid surface) (g))

BRIEF DESCRIPTION OF THE DRAWINGS

The accompanying drawings, which are incorporated in and constitute a part of the specification, illustrate preferred embodiments of the invention and, together with the general description given above and the detailed description of the preferred embodiments given below, serve to explain the principles of the invention.

Figure 3:
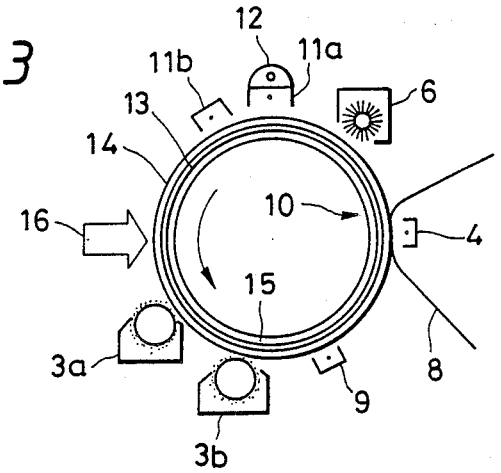
FIG. 3 is a schematic diagram of a color picture recording apparatus incorporating a first embodiment of the present invention.
Figure 4A:
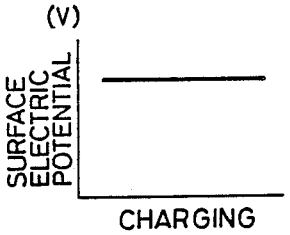
Figure 4B:
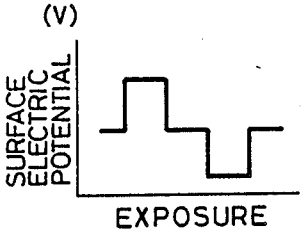
Figure 4C:
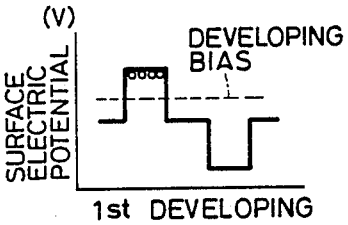
Figure 4D:
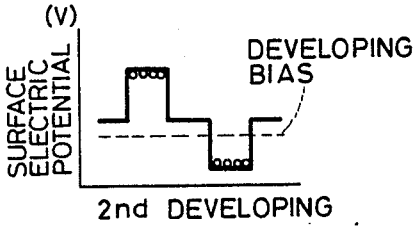
Figure 5:
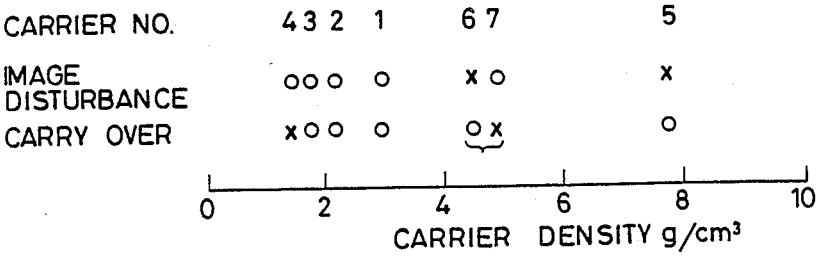
Figure 6:
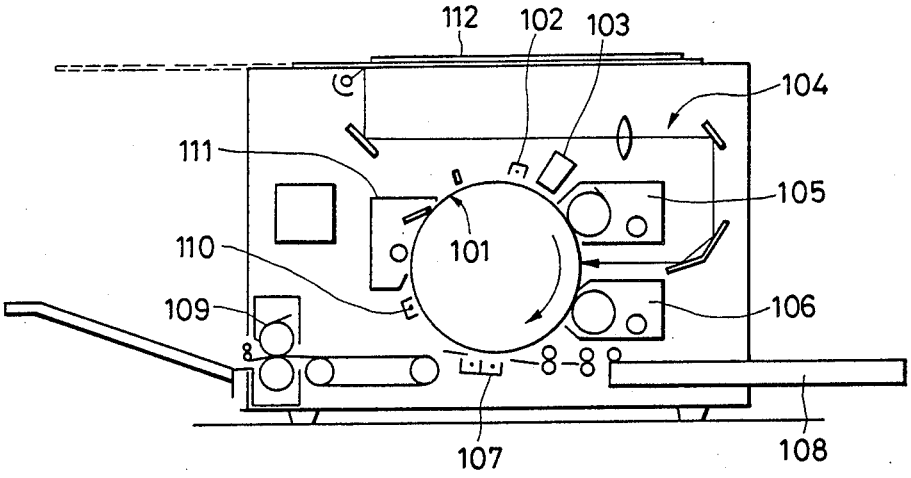
Figure 7A:
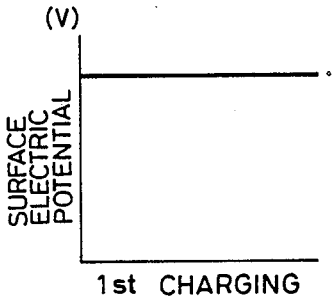
Figure 7B:
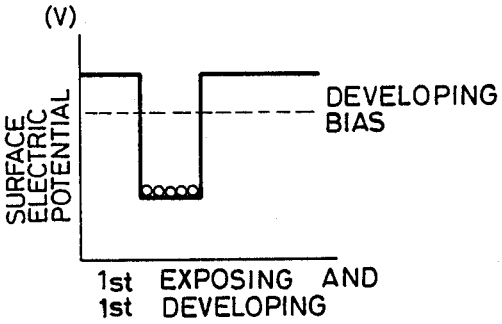
Figure 7C:
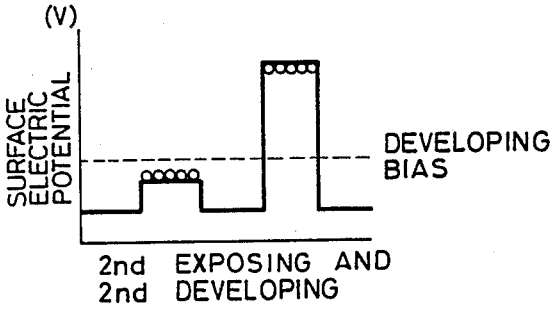
Figure 8:
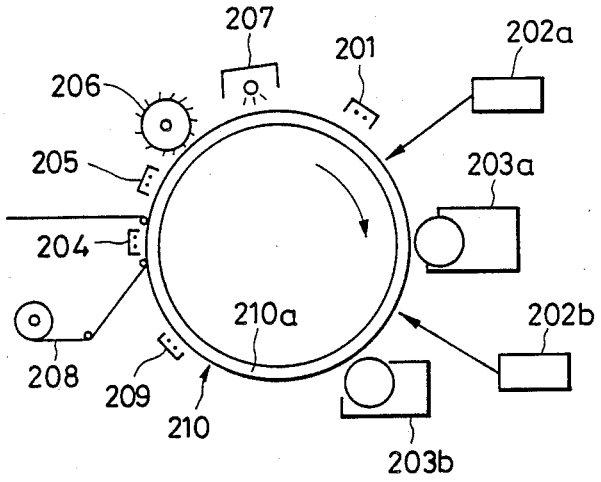
Figure 9A:
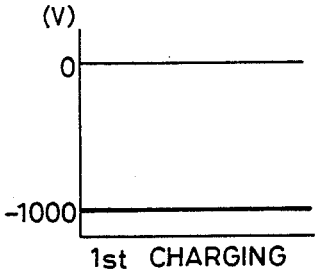
Figure 9B:
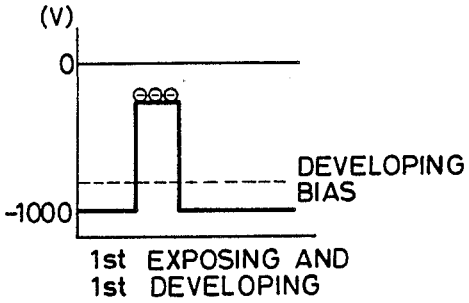
Figure 9C:
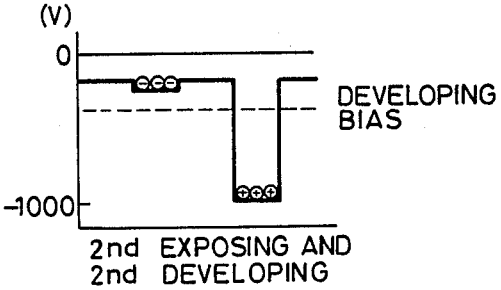
Figure 10:
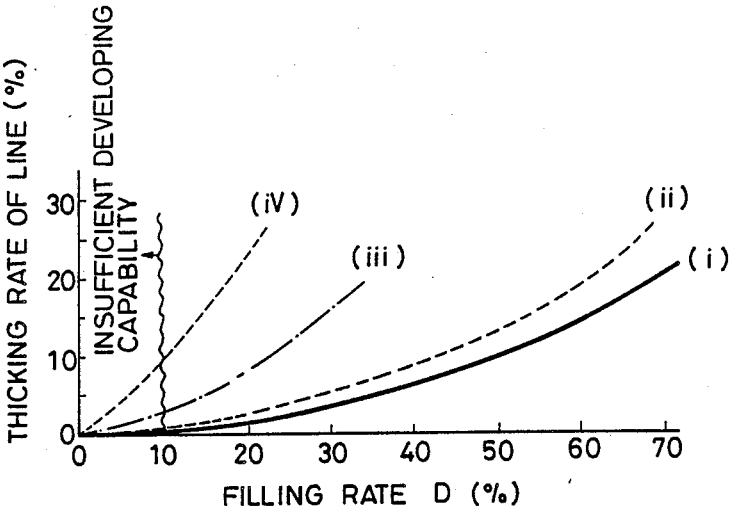
Figure 11:
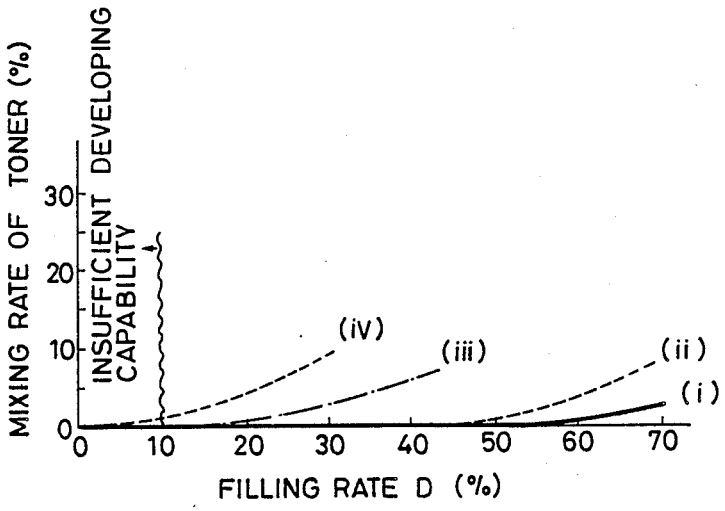
Figure 12A:
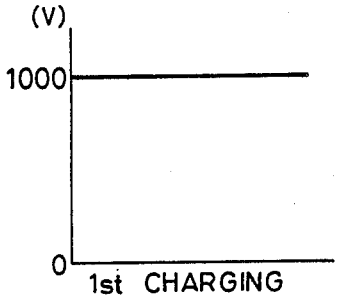
Figure 12B:
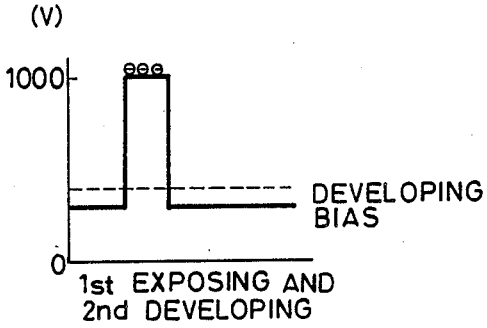
Figure 12C:
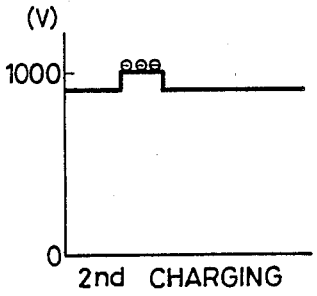
Figure 12D:
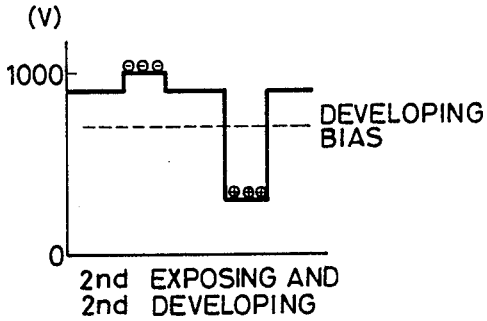
Figure 13:
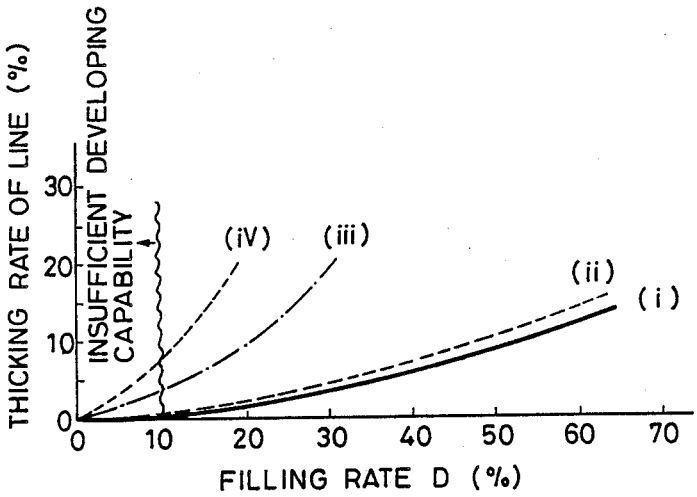
Figure 14:
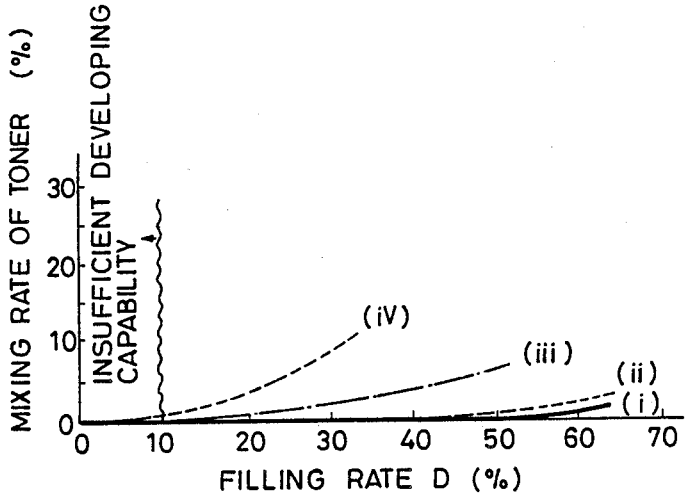
Figure 15:
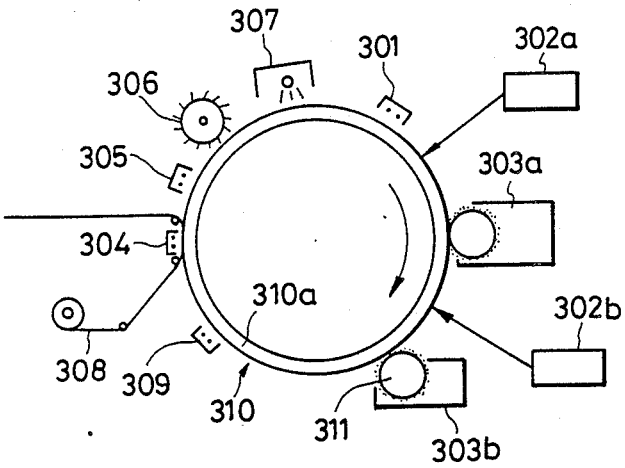
Figure 16A:
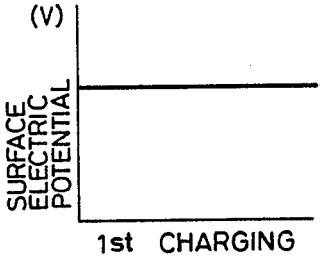
Figure 16B:
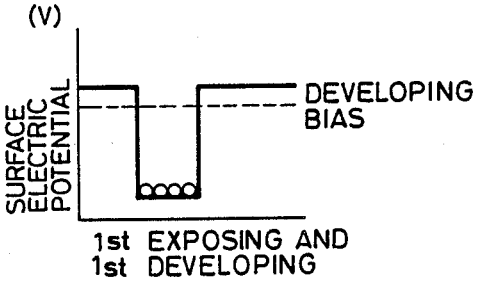
Figure 16C:
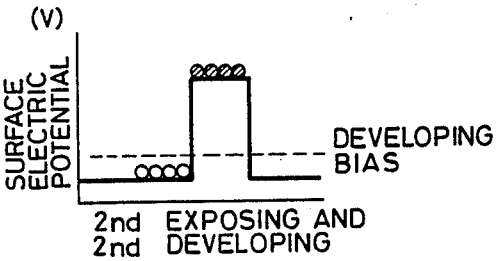
Figure 17:
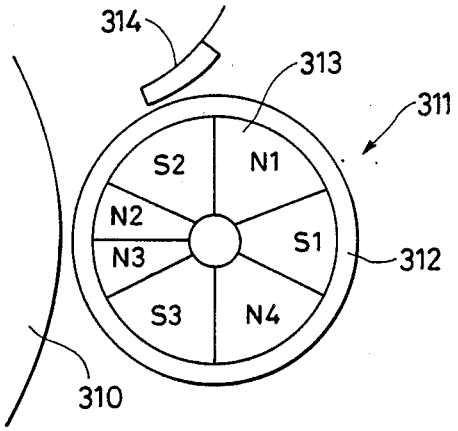
Figure 18:
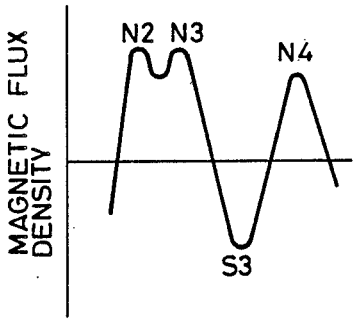
Figure 19:
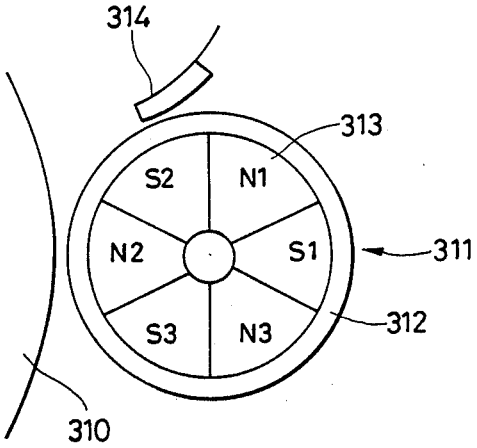
Figure 20A:
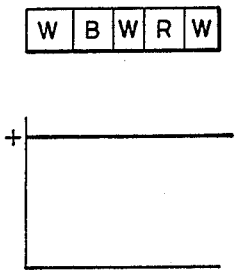
Figure 20B:
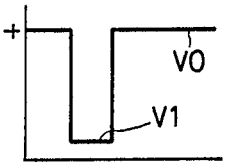
Figure 20C:
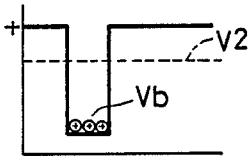
Figure 20D:
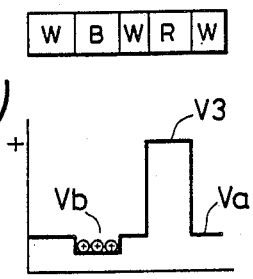
Figure 20E:
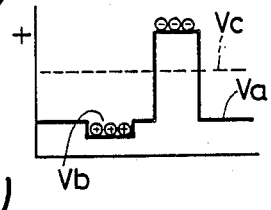
Figure 20F:
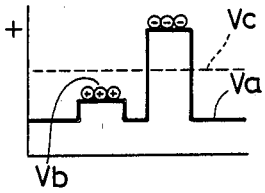
Figure 21:
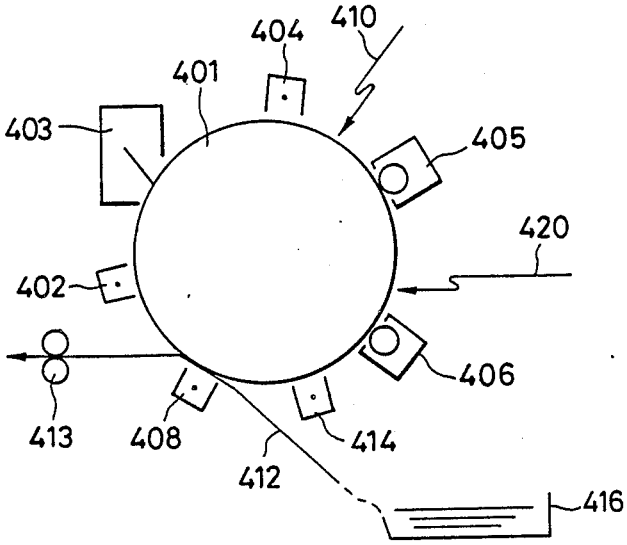
Figure 22:
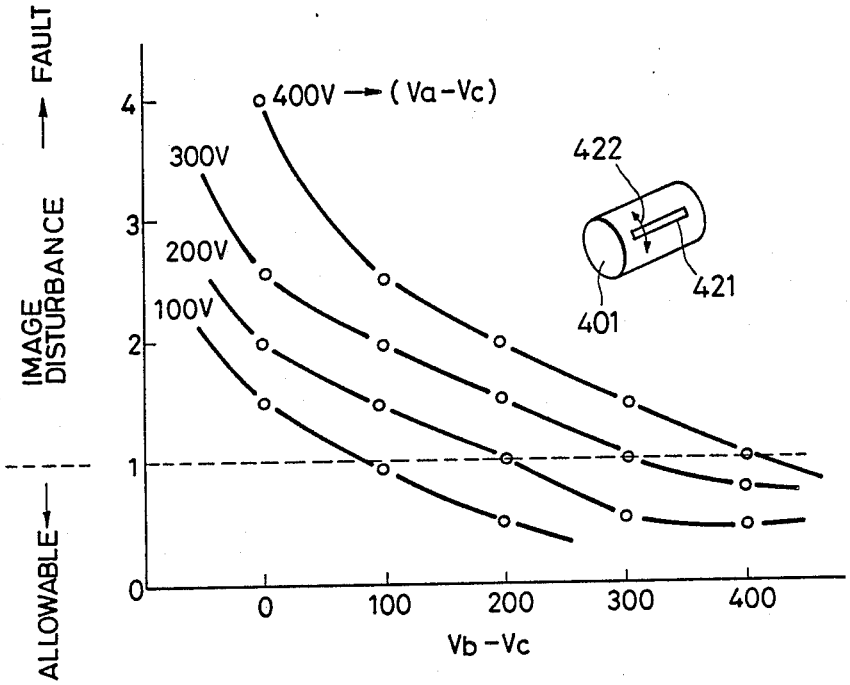

FIGS. (*a*)–(*d*) show graphs explaining the surface voltage of a photosensitive medium for various developing conditions during operation of the color picture recording apparatus of FIG. 3;

FIG. 5 is a diagram showing the relationship between carrier density, image disturbance and carry-over phenomenon;

FIG. 6 is a schematic diagram of a second embodiment of a picture recording apparatus incorporating the teachings of the present invention;

FIGS. 7(*a*)–(*c*) show graphs explaining the surface voltage of a photosensitive medium for various developing conditions during operation of the picture recording apparatus of FIG. 6;

FIG. 8 is a schematic diagram of a third embodiment of a color picture recording apparatus incorporating the teachings of the present invention;

FIGS. 9(*a*)–(*c*) show graphs explaining the surface voltage of a photosensitive medium for various developing conditions during operation of the picture recording apparatus of FIG. 8;

FIG. 10 is a graph of the relationship between the filling rate of developer and the thickening rate of a line according to Test 1;

FIG. 11 is a graph of the relationship between the filling rate of developer and the toner mixing rate according to the Test 1;

FIGS. 12(*a*)–(*d*) show graphs explaining the surface voltage of a photosensitive medium for various developing conditions during Test 3 operation of the picture recording apparatus of FIG. 8;

FIG. 13 is a graph of the relationship between the filling rate of developer and the thickening rate of a line according to Test 3;

FIG. 14 is a graph of the relationship between the filling rate of developer and the mixing rate of toner in Test 3;

FIG. 15 is a schematic diagram of a fourth embodiment of a color picture recording apparatus incorporating the teachings of the present invention;

FIGS. 16(*a*)–(*c*) show graphs explaining the surface voltage of a photosensitive medium for various developing conditions during operation of the picture recording apparatus of FIG. 15;

FIG. 17 is a schematic diagram of the developing roll used in the apparatus of FIG. 15;

FIG. 18 is a graph of the magnetic flux density of the developing roll of FIG. 17;

FIG. 19 is a schematic diagram of a developing roll generally used in a developing device;

FIGS. 20(*a*)–(*f*) illustrate the voltages of respective portions of the photosensitive medium in an example of the color recording method of a fifth embodiment of the invention;

FIG. 21 is a schematic diagram of a fifth embodiment of a color picture recording apparatus incorporating the teachings of the present invention;

FIG. 22 is a graph for evaluating the performance of the apparatus of FIG. 21.

Figure 23A:
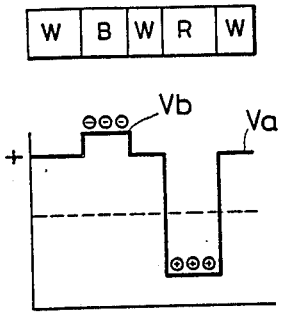
Figure 23B:
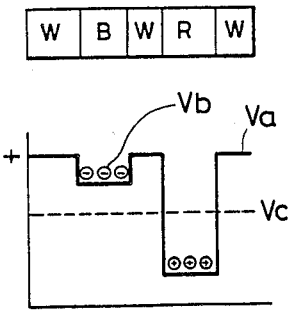
Figure 24:
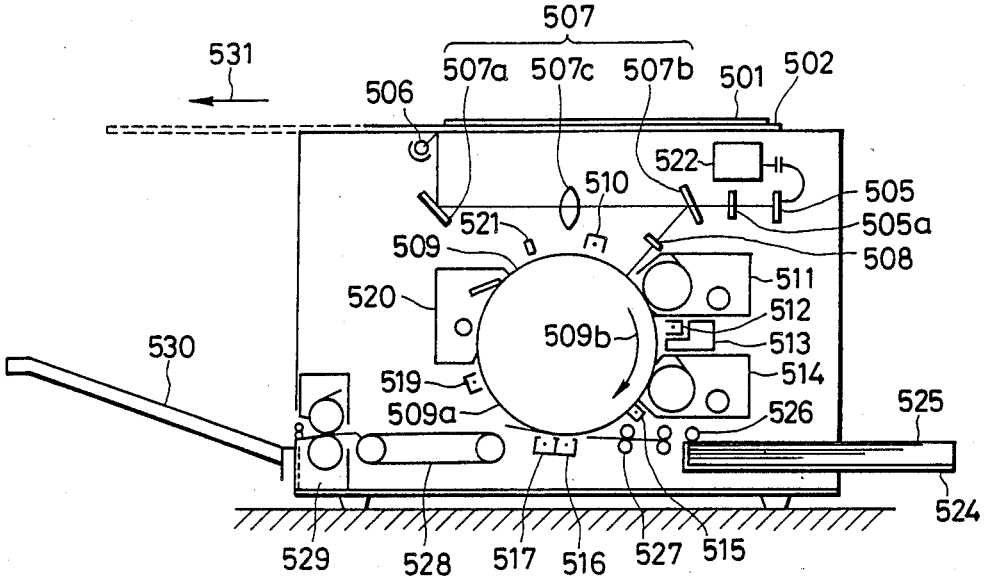
Figure 26:
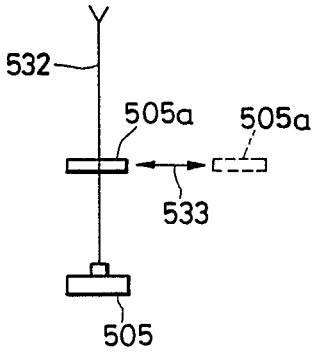
Figure 27:
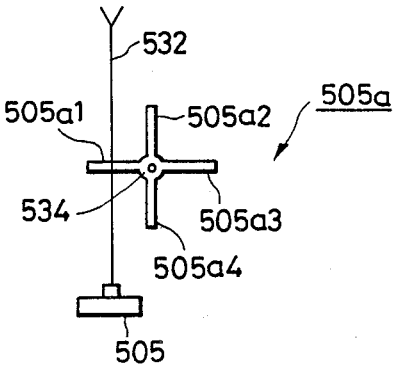
Figure 25A:
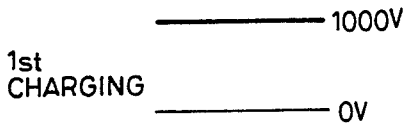
Figure 25B:
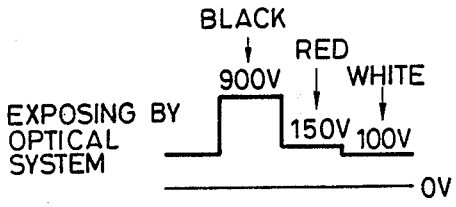
Figure 25C:
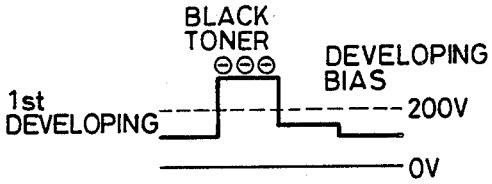
Figure 25D:
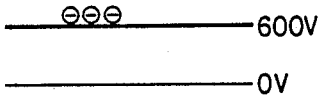
Figure 25E:
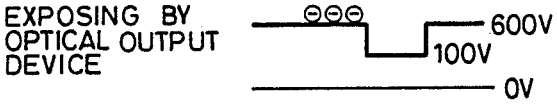
Figure 25F:
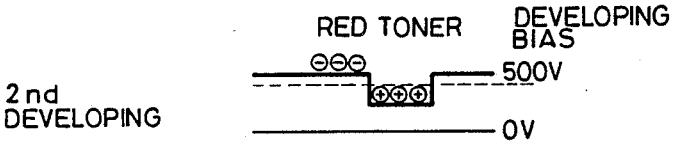
Figure 25G:
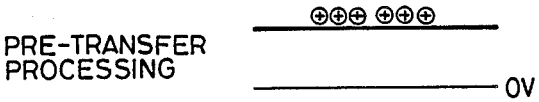
Figure 28:
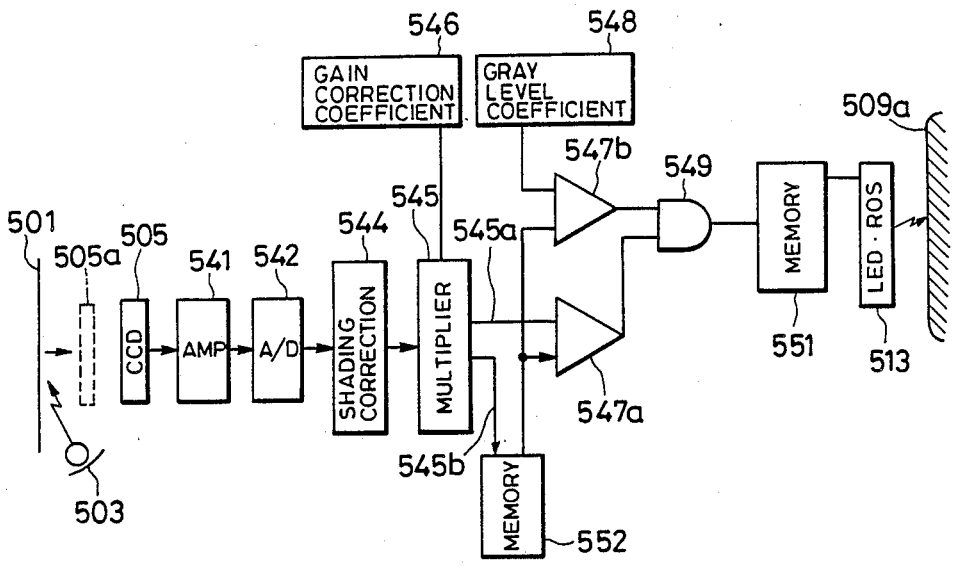
Figure 29:
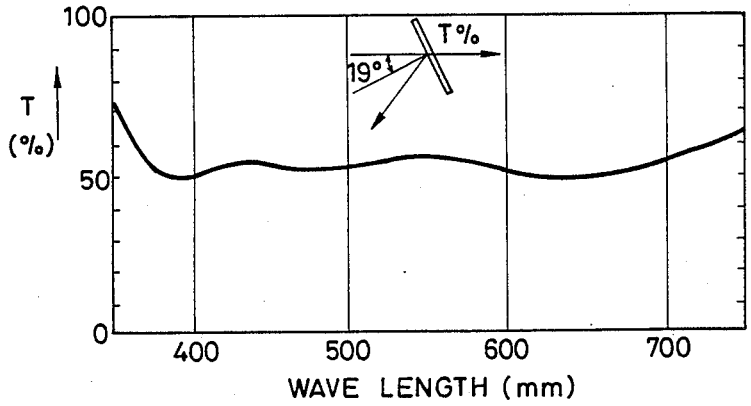
Figure 30:
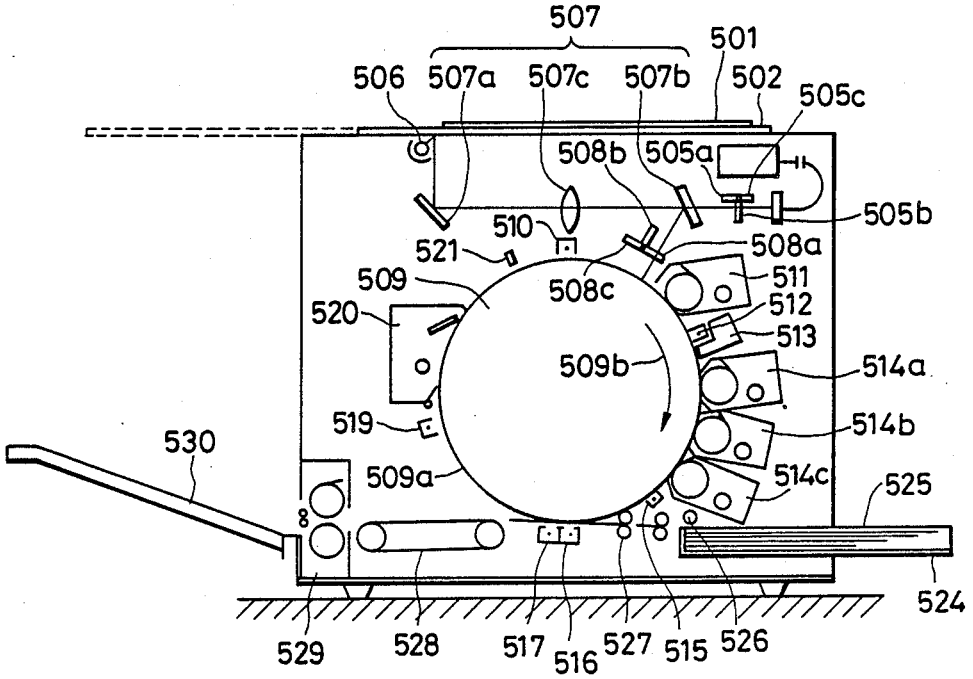
Figure 31A:
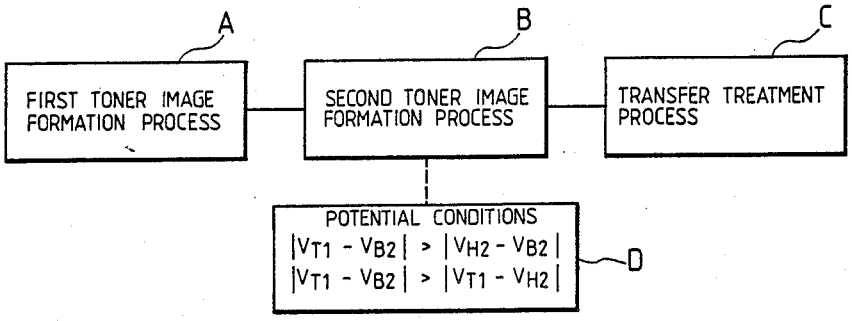
Figure 31B:
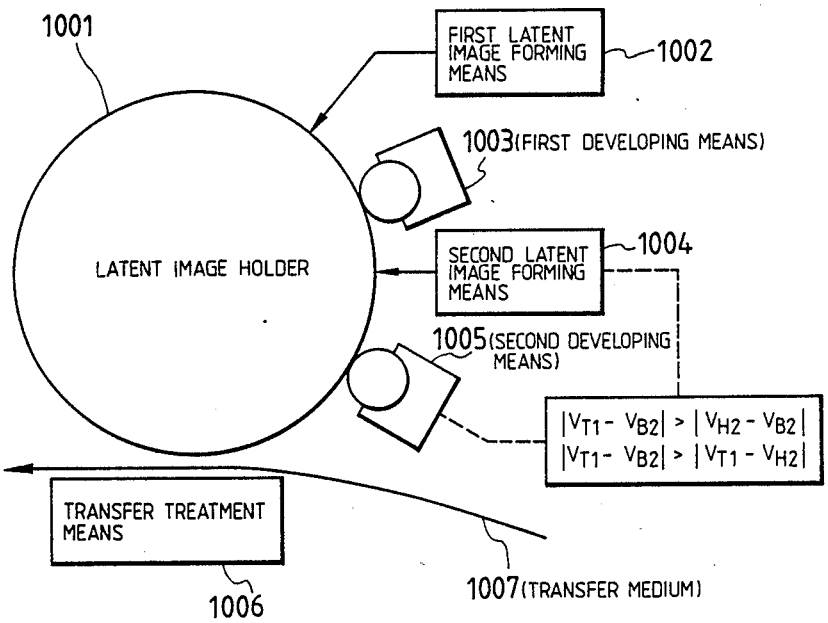
Figure 32A:
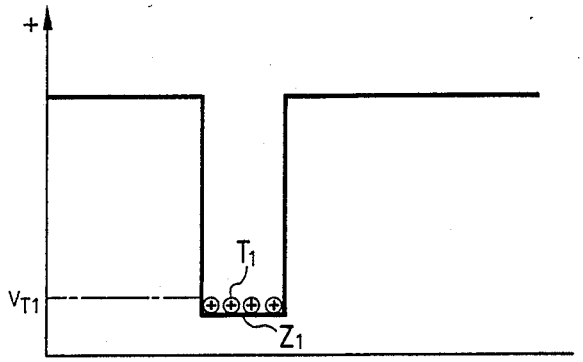
Figure 32B:
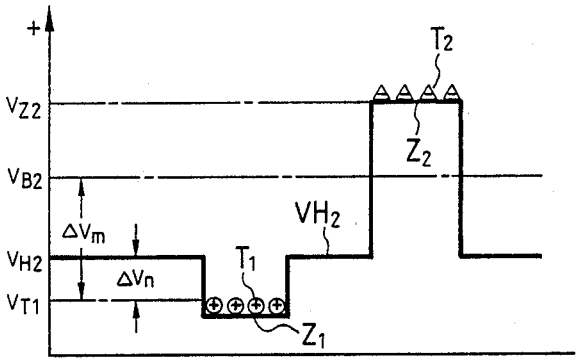
Figure 32C:
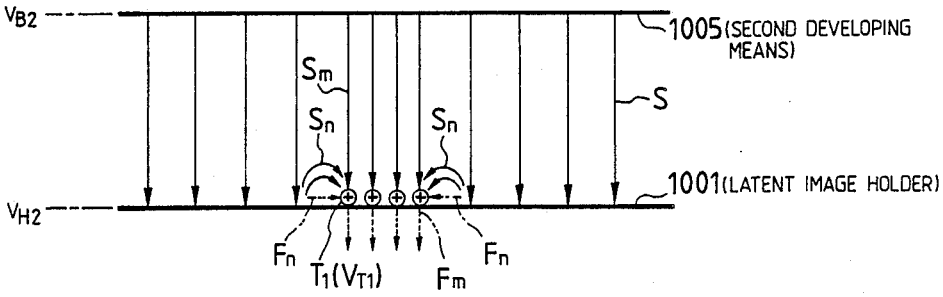
Figure 33A:
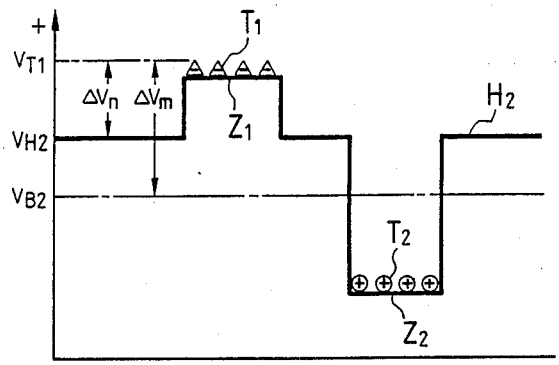
Figure 33B:
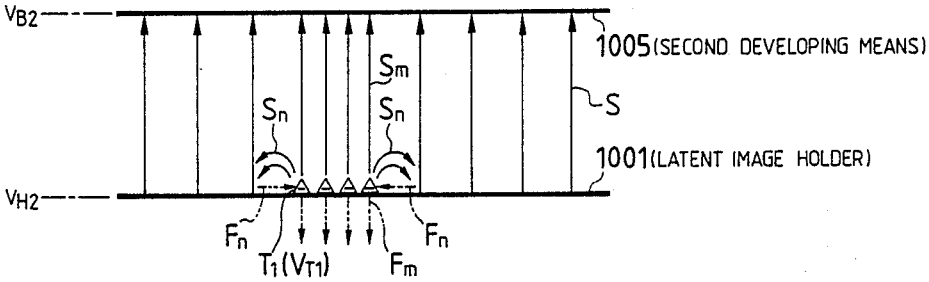
Figure 34:
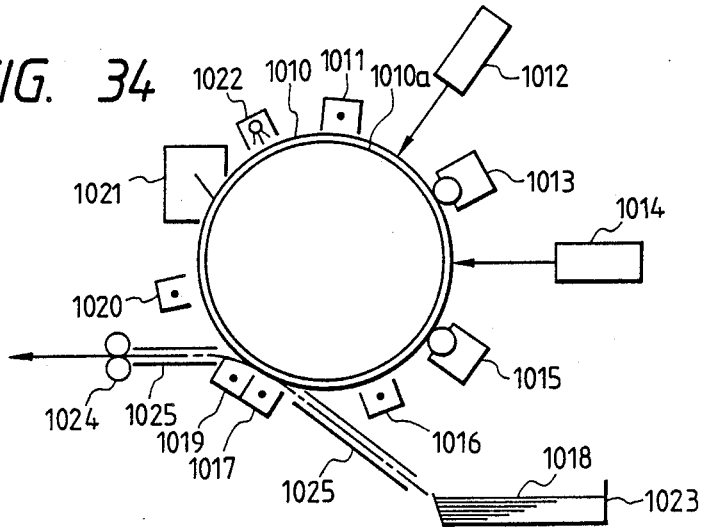
Figure 36A:
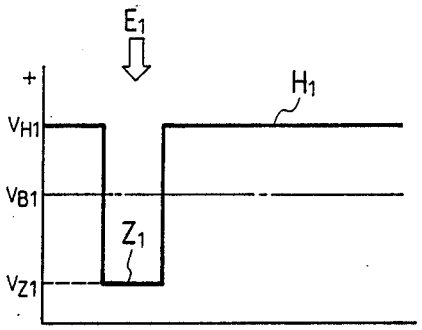
Figure 36B:
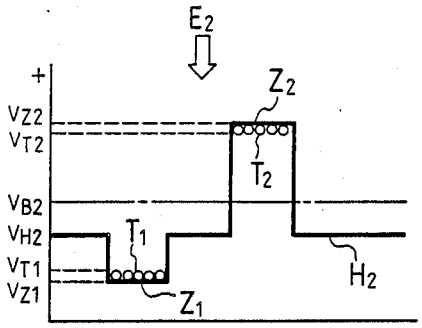
Figure 37:
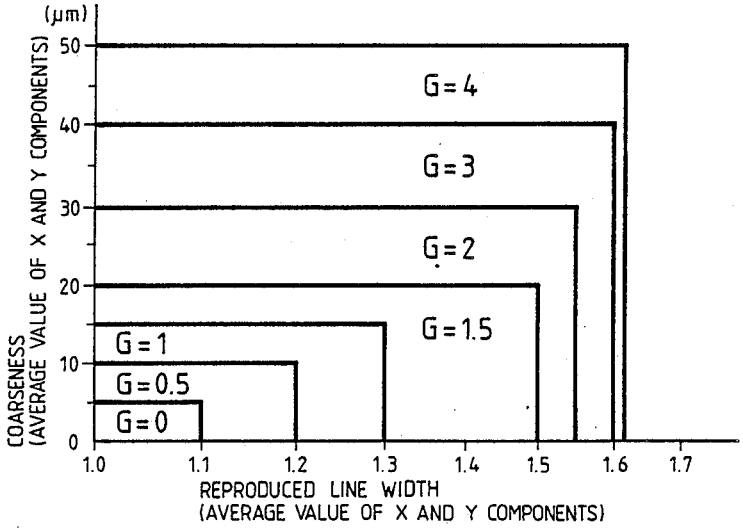
Figure 38:
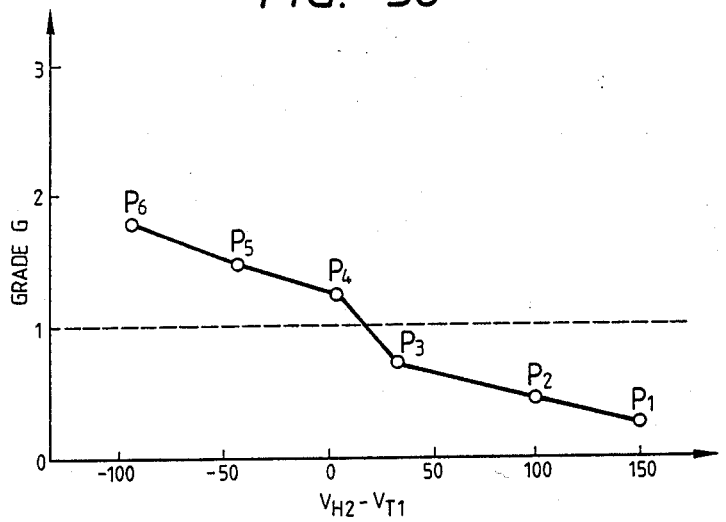
Figure 39:
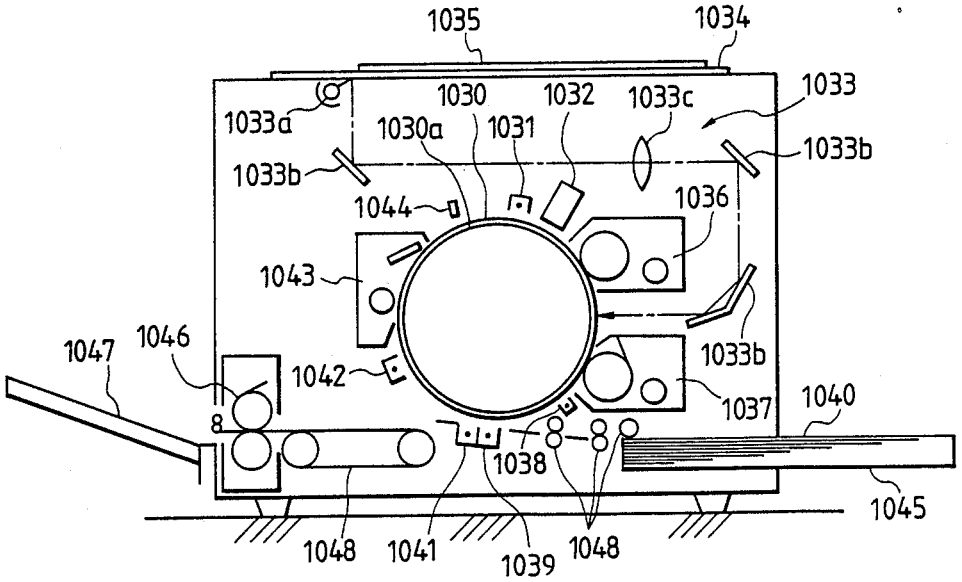
Figure 40:
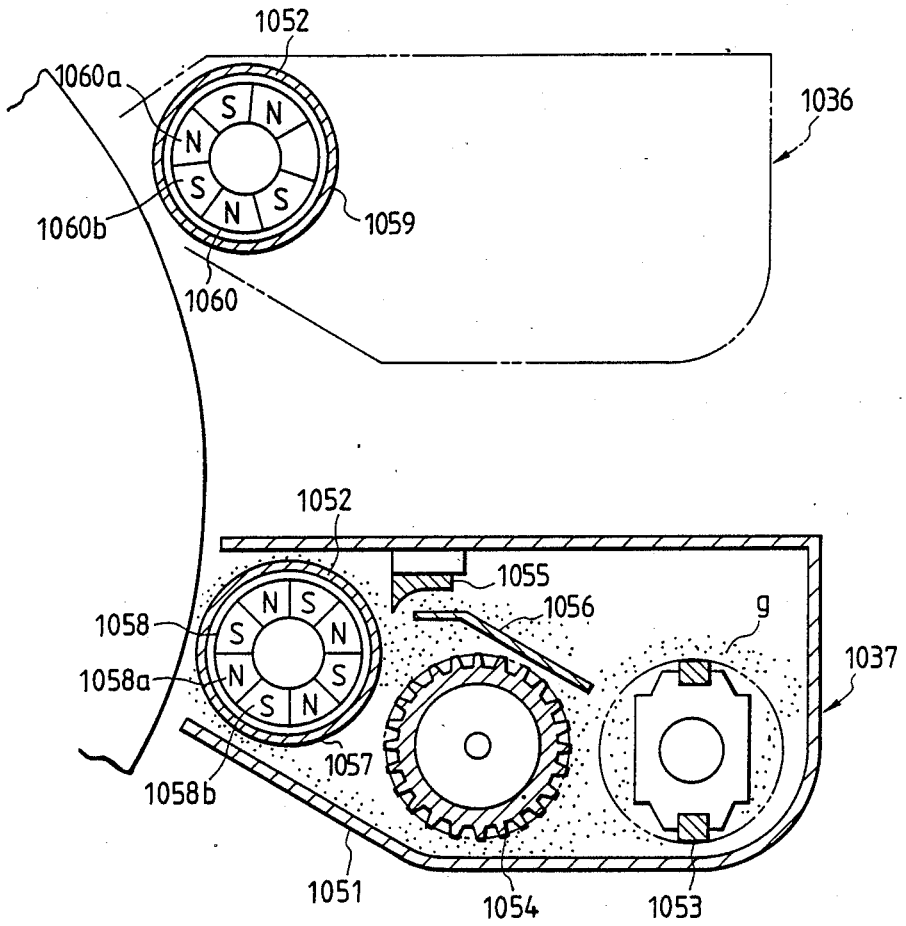
Figure 42A:
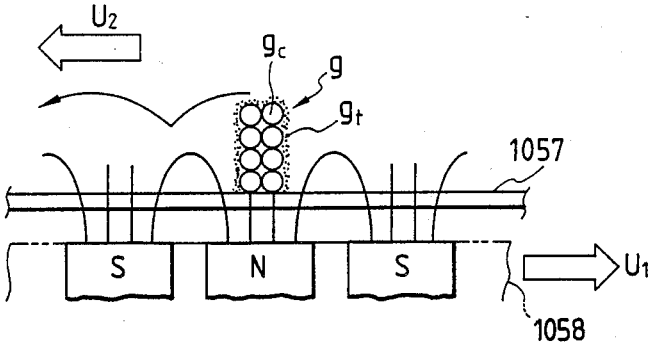
Figure 42B:
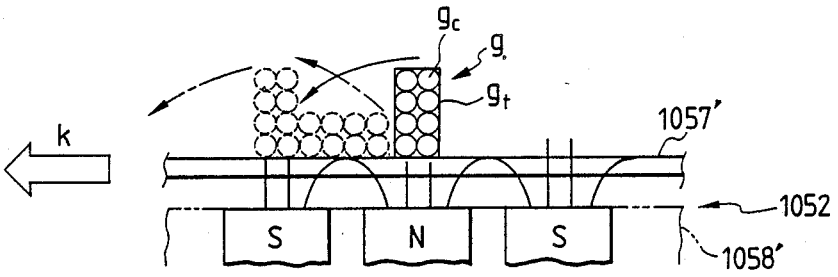
Figure 43:
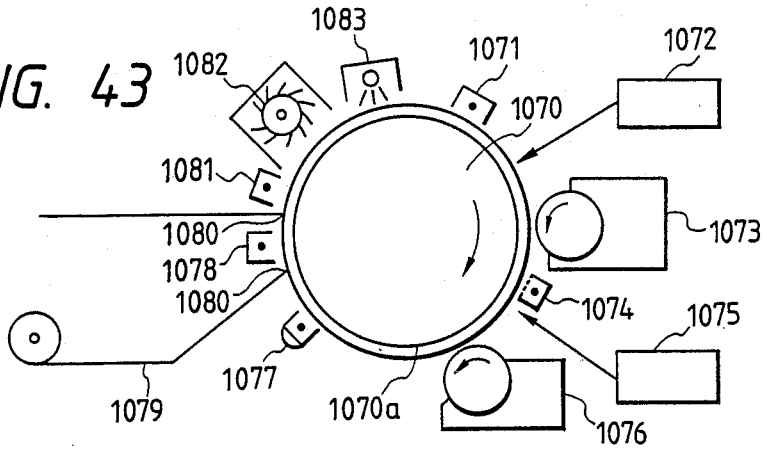
Figure 44:
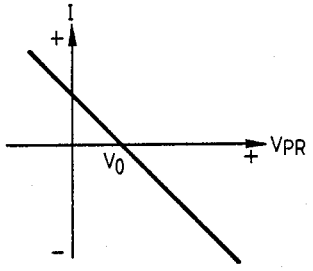
Figure 46:
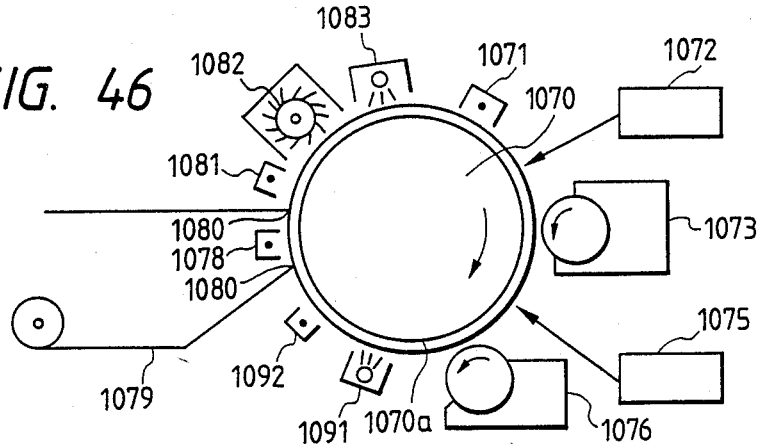
Figure 48A:
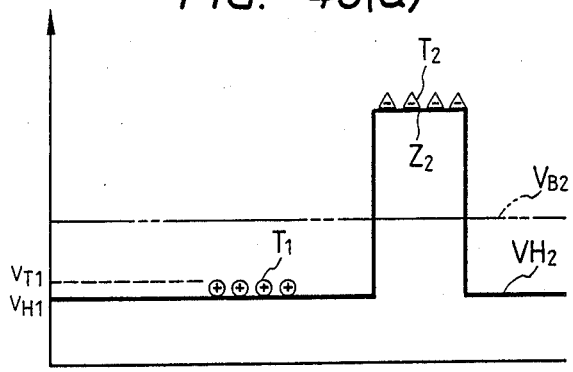
Figure 48B:
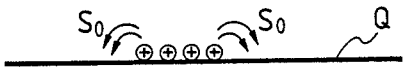
Figure 48C:
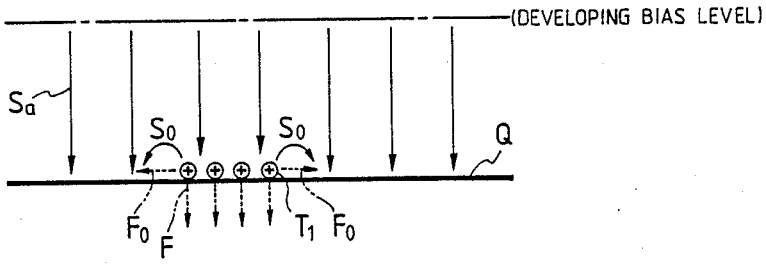

FIGS. 23(*a*) and (*b*) explain the surface voltage of a photosensitive medium for various developing conditions during operation of the picture recording apparatus of FIG. 21;

FIG. 24 is a schematic diagram of a sixth embodiment of a copying apparatus incorporating the teachings of the present invention;

FIGS. 25(a)–(g) show graphs explaining the surface voltage of a photosensitive medium for various developing conditions during operation of the picture recording apparatus of FIG. 24;

FIGS. 26 and 27 show structures of principal portions of the examples of the movable filters;

FIG. 28 is a block diagram of a signal processing circuit incorporating the teachings of the present invention;

FIG. 29 is a graph indicating characteristics of a half-mirror;

FIG. 30 is a schematic diagram of a second example of the sixth embodiment of a copying apparatus incorporating the teachings of the present invention;

FIG. 31(a) is a block diagram of the processes of an image forming method according to the seventh embodiment of the invention;

FIG. 31(b) is a schematic diagram of a seventh embodiment of an image forming apparatus incorporating the teachings of the present invention;

FIG. 32(a) is a graph of the first toner image formation process in an image forming method according to the seventh embodiment, which adopts negative-positive development;

FIG. 32(b) is a graph of the second toner image formation process in an image forming method according to the seventh embodiment, which adopts negative-positive development;

FIG. 32(c) is a diagram of the state of an electric field acting on the peripheral portion of the first toner image during a second toner image formation process of FIG. 32(b);

FIG. 33(a) is a graph of the second toner image formation process in the image forming method of the seventh embodiment, which adopts positive-negative development;

FIG. 33(b) is a diagram of the state of an electric field acting on the peripheral portion of the first toner image during the second toner image formation process of FIG. 33(a);

FIG. 34 is a schematic diagram of a two-color printer of Example 1 of the seventh embodiment of the invention;

FIGS. 35(a)–(f) are graphs of the image forming processes of Example 1;

FIGS. 36(a) and 36(b) are graphs of potential parameters in Experimental Examples 1 to 6;

FIG. 37 is a diagram of a standard for grading the image characteristics in the Experimental Examples 1 to 6;

FIG. 38 is a graph showing the relationship between VTI, VB2 and the grades;

FIG. 39 is a schematic of the two-color copying machine of the Example 2 of the seventh embodiment of the invention;

FIG. 40 is a schematic diagram of the developing units in Example 2;

FIGS. 41(a)–(e) are graphs of the image forming processes in Example 2;

FIG. 42(a) is a schematic diagram of the developing operation of the second developing unit in Example 2;

FIG. 42(b) is a schematic diagram of the developing operation of a developing unit of another type;

FIG. 43 is an explanatory view a two-color printer of Example 3 of the seventh embodiment of the invention;

FIG. 44 is a graph of the characteristics of the exposing and charging corotron used in Example 3;

FIG. 45(a)–(f) are graphs of the image forming processes in Example 3;

FIG. 46 is a schematic diagram of a two-color printer of Example 4 of the seventh embodiment of the invention;

FIGS. 47(a)–(e) are graphs of the image forming processes of Example 4;

FIG. 48(a) is a graph of a generally-applied image forming method;

FIG. 48(b) is a diagram of the state of an electric field on the peripheral portion of the first toner image during formation of the second toner image in a generally-applied method; and FIG. 48(c) is a diagram of the state of an electric field on the peripheral portion of the first toner image in the second toner image formation process in the generally-applied method to which magnetic brush development is adapted.

DETAILED DESCRIPTION OF THE PREFERRED EMBODIMENTS

Reference will now be made in detail to the present preferred embodiment of the invention as illustrated in the accompanying drawings. The first and second embodiments of the present invention will be described below. The first embodiment is a color image recording method, to which the teachings of the present invention are applied. The second embodiment is a composite image recording method, to which the teachings of the present invention are applied.

According to the first and second embodiment of the present invention, in developing processes (at the second and the subsequent developing processes), any kind of double-element developing device may be used, but it is preferable to use an ordinary magnetic brush developing device.

A magnetic brush developing device forms a magnetic brush by depositing a double-element developer on a developing roll. The developing roll consists of a magnet roll having a plurality of magnetic poles and a non-magnetic cylindrical sleeve provided at the circumference thereof. The length of the tipping part or magnetic brush is adjusted with a conventionally selected magnetic brush or tipping part limiting member. Development results from adhesion of toner to the latent image during the rubbing of the surface of a photosensitive medium, which is provided opposed to the magnetic brush, while moving the magnetic brush through the relative movement of magnet roll and sleeve.

In this case, it is desirable from the viewpoint of preventing disturbance of the image, to fix the magnet roll and rotate the sleeve. It is also desirable that the direction of rotation of the sleeve is the same as that of the photosensitive medium at the developing part. In addition, it is most desirable that the magnet roll fixed in the interior is arranged in such a manner as to form a repulsion magnetic field at least at the developing nip position.

The grain size of low density carrier particles in the first and second embodiments of the present invention can be selected freely, but experimental results indicate that an average grain size of from 25 to 50 μm is desirable. An average grain size of about 30 μm is the most suitable. If the average grain size deviates from this range, it becomes difficult to balance the prevention of carry over and image disturbance phenomena.

The first embodiment of the present invention will now be described with reference to FIGS. 1-5. The first embodiment of the present invention is a color image recording method, to which the present invention is applied.

The color image recording method of the first embodiment comprises a latent image forming process to form an electrostatic latent image on a latent image carrier by a latent image forming means. A developing process is used to visualize the formed electrostatic latent image, using different toners for two or more colors and a transfer process for transferring visualized color toner images to a transfer material after conducting several times at least the developing process among the developing process and the latent image forming process. A double-element developer is formed by mixing toner and a magnetic carrier having a density of 4.0 g/cm$^3$ or less. The developer is used in the developing processes during the second and the subsequent trials of the developing processes. The density $\rho$ is preferably in a range of 1.7 to 4.0 g/cm$^3$, and is more preferably in a range of 1.7 to 3.0 g/cm$^3$.

Figure 1:
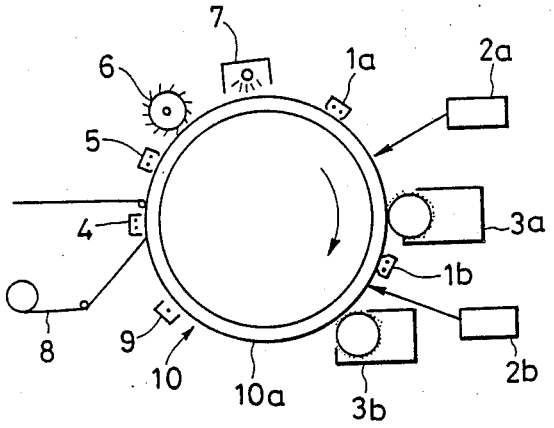
FIG. 1 is a schematic diagram of a color picture recording apparatus incorporating a first embodiment of the teachings of the present invention.
Figure 2A:
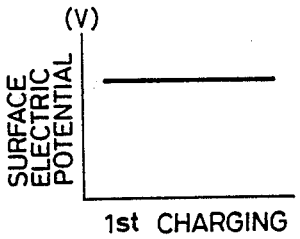
FIGS. 2(*a*)–(*d*) show graphs explaining the surface voltage of a photosensitive medium for various developing conditions during operation of the color picture recording apparatus of FIG. 1.
Figure 2B:
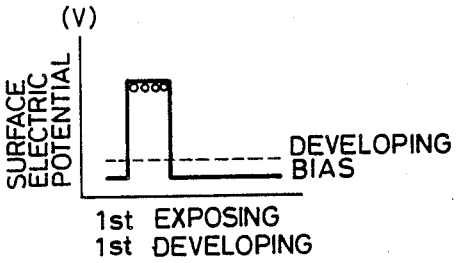
Figure 2C:
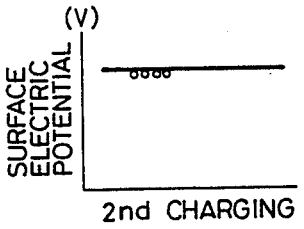
Figure 2D:
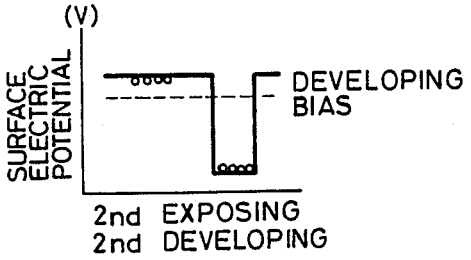

FIG. 1 shows one example of a color picture recording apparatus used by the color image recording method of the first embodiment of the present invention to form color pictures through formation of two-level latent images. FIGS. 2(*a*)-(*d*) show the surface electric potential of the photosensitive medium and developing step during operation of the color picture recording apparatus of FIG. 1. FIG. 1 shows first charger 1*a*, first exposing means 2*a*, first developing means 3*a*, second charger 1*b*, second exposing means 2*b*, second developing means 3*b*, transfer corotron 4, preclean corotron 5, cleaner 6, optical precleaner 7, recording paper 8, pretransfer corotron 9, photosensitive drum 10, and photosensitive layer 10*a*.

Turning to the operation of the apparatus of FIG. 1, photo sensitive drum 10 rotates in the direction indicated by the arrow mark. First, the photosensitive layer 10*a* at the surface of photosensitive drum 10 is uniformly charged as shown in FIG. 2(*a*) by first charger 1*a*.

Next, light irradiation is carried out, depending on the picture information, corresponding to a first color by the first exposing means 2*a*. An electrostatic latent image corresponding to the first color is formed on photosensitive layer 10*a*. Any conventional type of exposing means may be used.

To visualize the image, toner corresponding to the first color is supplied by the first developing means 3*a* to the photosensitive layer 10*a*. Layer 10*a* has the first electrostatic latent image formed by the first exposing means, as shown by the graph of FIG. 2(*b*). The color of the toner may be different from the first color. Any conventional type of developing means may be used as the first developing means. In this case, the developing bias is selected depending on whether regular developing or inverse developing is to be carried out.

Next, photosensitive layer 10*a* is uniformly charged again by second charger 1*b* as shown in FIG. 2(*c*). Second charger 1*b* may be omitted depending on the image forming process. For example, when a negative image is written in the first exposing part and a positive image is written in the second exposing part, such second charger may be omitted. Light irradiation is now carried out depending on the picture information corresponding to the second color by second exposing means 2*b*. The latent image for the second color is formed on photosensitive layer 10*a*. Conventional exposing means and writing systems may be used. To visualize the image, toner corresponding to the second color is then supplied by second developing means 3*b* to photosensitive layer 10*a*. Layer 10*a* has a second electrostatic latent image formed by the second exposing means as shown in FIG. 2(*d*). In this case, the color of toner may also be different from the second color and the developing bias may also be selected in the conventional manner.

Pre-transfer corotron 9 is used to match or equalize with each other the polarities of the first and second toners deposited on photosensitive medium 10*a* prior to transfer, and it also may be omitted for the particular process. The first toner image and the second toner image are transferred by transfer corotron 4 to recording paper 8, but such transfer may also be done using a means other than electrostatic transfer. The image is then fixed on the recording paper by a fixing means (not shown). The photosensitive medium is now subject to a cleaning process by preclean corotron 5, cleaner 6 and photo-precleaner 7 to prepare it for subsequent use.

Means consisting of, but not limited to light irradiation means, document scanning means and optical systems for focusing may be used as the first and second exposing means. Various kinds of devices such as optical writing devices which use optical modulation depending on the picture information, for example, laser writing devices, liquid crystal light bulbs consisting of a uniform light source and a liquid crystal microshutter or LED array, or optical fibers may be used as desired and if appropriate for the purpose.

In the first embodiment of the present invention, two kinds of developers are used in different color phases by the color recording apparatus of FIG. 1. It is essential to use a double-element developer consisting of toner and magnetic carrier with a density of 4.0 g/cm$^3$ or less in the second developing means.

FIG. 3 shows another color picture recording apparatus used for the color image recording method of the first embodiment. In the embodiment of FIG. 3, the color picture may be formed using three-levels of latent images. FIG. 4 shows the surface potential of photosensitive medium 14 and the developing condition during operation of the color picture recording apparatus of FIG. 3. The color picture recording apparatus of FIG. 3 comprises primary charger 11*a*; secondary charger 11*b*; uniform exposing device 12; first photosensitive layer 13; second photo sensitive layer 14; base material 15; and laser source 16. Reference numerals common to FIG. 1 indicate the same elements as those of FIG. 1.

Turning to the operation of the apparatus of FIG. 3, first, while the surface of photosensitive drum 10 is uniformly charged, it is subjected to primary charging by primary charger 11*a*, and is then subjected to secondary charging in a reversed polarity from the primary charging by secondary charger 11*b*, resulting in the charge distribution of FIG. 4(*a*). Next, the surface of drum 10 is exposed to a laser beam at two intensity levels which are obtained by modulation of the laser beam from laser source 16 in order to form a latent image of three levels as shown in FIG. 4(*b*). While a developing bias is applied, the toner corresponding to the first color is supplied by first developing means 3*a* for visualizing the image as shown in FIG. 4(*c*). Next the developing bias is selected and the toner corresponding to the second color is supplied by second developing means 3*b* for visualizing the image as shown in FIG. 4(*d*). The visualized toner image is then transferred to recording paper 8 and is fixed thereon in a conventional manner.

EXPERIMENT 1

The double-element developer to be used in the first embodiment of the present invention is manufactured as explained below.

1. The Carrier:

The following carriers were obtained by mixing a copolymer of styrene-n-butylmethacrylate, having a density of 1.1 g/cm$^3$, and cubic type magnetite, having a density of 4.8 g/cm$^3$, in the proportions indicated below. The raw material was melted, kneaded and milled to obtain the carrier having the properties shown below.

| Carrier No. | Resin/magnetic powder (parts by weight) | Density (g/cm$^3$) | Average grain size (μm) |
|---|---|---|---|
| 1 | 20/80 | 2.9 | 30 |
| 2 | 35/65 | 2.2 | 30 |
| 3 | 50/50 | 1.8 | 30 |
| 4 | 65/35 | 1.5 | 30 |

2. The Toner:

Toner with an average grain size of 9.8 μm was obtained by melting and kneading resin of 92 parts by weight obtained through a graft polymerization of a low molecular weight polyolefin and a styrenebutylmethacrylate copolymer, and red color pigment of 8 parts by weight (for example, resolscarlet, manufactured by BASF AG), and then milling the resulting material.

3. The Double-Element Developer

The developer was obtained by mixing 90 parts by weight of the above-indicated carrier and 10 parts by weight of the above-indicated toner.

The tests were conducted using the color picture recording apparatus of FIG. 3. Here, a Se photosensitive medium was used with first and second charging voltages of 1100 V. For the exposure, laser 16 was a He-Ne laser (pulse width was modulated by a single laser) and the electrostatic latent image of three-levels was formed with a voltage of 1100 V for the non-exposed region, 700 V for the intermediately exposed region and 200 V for the fully exposed region. Then, while the developing bias of 800 V was applied, a black toner image was formed by the double-element magnetic brush method using the first developing means.

Next, while a developing bias of 600 V was applied, the red toner image was formed by said double-element magnetic method using the second developing means.

For comparison, tests were also conducted using the following carriers of double-element developer to be used for the second developing means.

| Carrier No. | | Density (ρ) (g/cm$^3$) | Average grain size (μm) |
|---|---|---|---|
| 5 | Iron system carrier | 7.8 | 60 |
| 6 | Ferrite | 4.5 | 60 |
| 7 | Ferrite | 4.5 | 15 (5 to 50 μm) |

The relationship between carrier density and image disturbance and carry-over phenomenon in these tests is shown by FIG. 5. In FIG. 5, a circle indicates that no image disturbance or no carry over phenomenon occurred, while a cross means generation of image disturbances and the carry over phenomenon did occur.

EXPERIMENT 2

These tests were conducted under the same conditions as the test of sample No. 4 that was used in Experiment 1 with the color picture recording apparatus of FIG. 1. The first exposure was a regular exposure (exposure of the picture-free part) and the second exposure was an inverse exposure (exposure of the picture part). The surface voltage of the photosensitive medium by the first charging was 900V and voltage of the exposure part by the first exposure was 200V.

The first developing was carried out using black toner with a developing bias voltage of 300V. The surface voltage of the photosensitive medium by the second charging was 900V and voltage of the exposure part by the second exposure was 200V. The second developing was carried out using red toner with a developing bias voltage of 800V. The result of testing was the same as that of test sample No. 4 of Experiment 1.

The color picture recording method of the first embodiment of the present invention using repeated development with the magnetic brush method and using the double-element developer, resulted in the toner image in the preceding stage of the repeated developing process being undisturbed and no generation of the carry-over phenomenon. Therefore, a high quality color picture without disturbances can be obtained by the present invention.

The second embodiment of the present invention will now be described with reference to FIGS. 6 to 7. The second embodiment is a composite image recording method, to which the present invention is applied, and which comprises a latent image forming process to form an electrostatic latent image on a latent image carrier by a latent image forming means; a developing process to visualize the formed electrostatic latent image using toners for a single color; and a transfer process for transferring the visualized toner image to a transfer material after repeating the developing process several times. A double-element developer, formed by mixing the toner and a magnetic carrier having a density of 4.0 g/cm$^3$ or less, is used in the developing process of at least the second and subsequent trials of the repetitive developing process. The density is preferably in a range of 1.7 to 4.0 g/cm$^3$ and more preferably in a range of 1.7 to 3.0 g/cm$^3$.

FIG. 6 is an example of a picture recording apparatus to be used for the image recording method of the second embodiment of the present invention. FIGS. 7(*a*)–(*c*) show the surface electric voltage of the photosensitive medium for the various developing conditions during operation of the picture recording apparatus of FIG. 6. The picture recording apparatus of FIG. 6 comprises photosensitive drum 101, charging corotron 102, LED array 103, exposing means 104, first developing means 105, second developing means 106, transfer corotron 107, recording paper 108, fixing means 109, preclean corotron 110, cleaner 111, and original document 112.

Turning to the operation of the apparatus of FIG. 6, the surface of photosensitive drum 101 is uniformly charged by charging corotron 102 to give the charge distribution of FIG. 7(*a*). Then, light irradiation is carried out, depending on picture information, by LED array 103, producing a first electrostatic latent image on the photosensitive medium. Next, while an adequate bias voltage is applied, the first toner image is formed by developing with first developing means 105 as shown in FIG. 7(*b*). In succession, the electrostatic latent image corresponding to the picture of original document 112 is formed by exposing the positive image with exposing means 104, which comprises a light irradiation means, a document scanning means and an optical focusing system. While the developing bias voltage is set to an adequate value, developing is conducted by second developing means 106 to form the second toner image as shown in FIG. 7(*c*).

The toner image is thus formed by repeated developing on the surface of photosensitive drum 101. This toner image is transferred to recording paper 108 by transfer corotron 107 but it may also be transferred by means other than electrostatic transfer means. The image on the recorder paper is then fixed by fixing means 109. The photosensitive drum 101 is cleaned by preclean corotron 110 and cleaner 111 for repeated use.

In FIG. 6, LED array 103 is the first exposing means, and the second exposing means comprises a light irradiation means, document scanning means and optical focusing system. These first and second exposing means may be replaced with other well known means.

In the second preferred embodiment, the single color developer is used as the developer for the color recording apparatus of FIG. 6. It is essential to use the double-element developer consisting of toner and magnetic carrier having a density of 4.0 g/cm$^3$ or less in the second developing means of the first and second developing means.

EXPERIMENT 3

The tests were conducted utilizing the picture recording apparatus of FIG. 6. The same double-element developers were used in these tests as were used in the tests of the first embodiment of the present invention, that is, the double-element developers used in the following tests were the developers manufactured as previously described in the first embodiment which contain carriers Nos. 1 through 4, and Nos. 5 through 7 for comparison.

An organic semiconductor system material was used as the photosensitive medium. The charging voltage was 900V. LED array 103 was used for the first exposure, and the latent image was formed to the non-exposed region with 900V and to the exposed region with 200V. Next, while a developing bias voltage of 800V was applied, the black toner image was formed by the double-element magnetic brush method using the first developing means. Next, the electrostatic latent image corresponding to the picture of the original document was newly formed by the second image exposure, using the exposing means consisting of the light irradiation means, document scanning means and optical focusing system. This electrostatic latent image was developed by the double-element magnetic brush method with the second developing means and the black toner image was formed. In this case, the developing bias voltage was set to 300V.

The relationship between the carrier density and image disturbance and carry over phenomenon in the tests was the same as shown by FIG. 5.

Using the picture recording method of the second embodiment of the present invention, which conducts repeated developing by the magnetic brush method using the double-element developer, pictures can be combined to the positive original document and moreover reproducibility of low concentration pictures is good. The picture formed by the first developing is not disturbed by the second developing, and there is no carry-over phenomenon. High quality pictures can therefore be generated by the present invention without disturbance of the image.

A third embodiment of the present invention will be described with reference to FIGS. 8–14. The third embodiment applies the present invention to a color image recording method. An important teaching of the third embodiment is that disturbance of the toner image can be further prevented, without lowering of developing concentration, by setting the filling rate in the developing nip of the double-element developer to a particular range in the second and successive developing process.

The third embodiment of a color picture recording method comprises: a latent image forming process to form an electrostatic latent image on a latent image carrier, using a latent image forming means; a developing process to visualize the electrostatic latent image using different toners for two or more colors; and a transfer process for transferring the visualized color toner image to a transfer material after several repetitions of at least the developing process among the latent image forming process and the developing process; and wherein a double-element developer formed from mixing a toner and a magnetic carrier having a density of 4.0 g/cm$^3$ or less is used in at least the second and subsequent developing processes; and wherein the developer filling rate in the developing nip ranges from 10% to 50%. The magnetic carrier used in the third embodiment is formed by dispersing magnetic powder into a resin binder, and the density thereof should be 4.0 g/cm$^3$ or less. The density can be easily controlled by adjusting the amount of magnetic powder. It is preferable that the density $\rho$ is in a range of 1.7 to 4.0 g/cm$^3$ and more preferably 1.7 to 3.0 g/cm$^3$ The grain size of the particles of the low density carrier used in the third embodiment is not critical, but the desirable average grain size is 30 $\mu$m to 5 $\mu$m, based on experiment. The optimum average grain size is about 4 $\mu$m, which increases developing efficiency by reduction of grain size, and when adhesion of the carrier to the latent image fringe field part is considered.

The magnetic brush developing device used in the developing method of the third embodiment of the invention comprises a developing roll consisting of a magnet roll having a plurality of magnetic poles and a nonmagnetic cylindrical sleeve provided at the circumference thereof. This forms a magnetic brush by depositing the double-element developer on the developing sleeve of the developing roll and by adjusting the magnetic brush or tipping part length with a conventionally selected magnetic brush limiting member. Development results from adhesion of toner to the latent image by rubbing, with the magnetic brush, the photosensitive medium surface, which is opposed to the magnetic brush, while moving the magnetic brush through the relative movement of the magnet roll and sleeve. The magnetic roll is fixed and the sleeve is rotated. It is preferable that the filling rate of developer in the developing nip should range from 10% to 50% in the second and successive developing processes. This improves the developing efficiency. If the filling rate is lower than 10%, the developing cannot be realized. If it is higher than 50%, the damage to the toner image by the first developing becomes large, and thereby the thickening rate of line and mixing rate of toner also become high.

Here, the "filling rate" means a filling degree of the carrier of the double-element developer in the developing nip and is expressed by the following equation.

$$D = \frac{Fx\,l\,xd}{hx\,l\,xd} \cdot \frac{1}{\rho} \left| \frac{V_{Dev} - V_{PR}}{V_{PR}} \right| = \frac{F}{h} \cdot \frac{1}{\rho} \left| \frac{V_{Dev} - V_{PR}}{V_{PR}} \right|$$

In the above equation,

D: filling rate (%)

l: effective developing roll length (cm)

d: developing nip width (cm)

h: distance between photosensitive medium and developing roll (cm)

F: amount of developer transferred on the developing roll (g/cm$^2$)

$\rho$: true density of carrier (g/cm$^3$)

$V_{PR}$: moving velocity of photosensitive medium (cm/sec)

$V_{Dev}$: moving velocity of developer (cm/sec).

In the third embodiment, the desired toner filling rate can be obtained by manipulation of the above parameters.

FIG. 8 is an example of a color picture recording apparatus employing the color image recording method of the third embodiment to form color pictures through formation of two-level latent images. The apparatus of FIG. 8, comprises charger 201, first exposing means 202a, first developing means 203a, second exposing means 202b, second developing means 203b, transfer corotron 204, preclean corotron 205, cleaner 206, optical precleaner 207, recording paper 208, pre-transfer corotron 209, and photosensitive layer 210a.

Turning now to the operation of the apparatus of FIG. 8, photo sensitive drum 210 rotates in the direction of the curved arrow mark. First, the photosensitive layer 210a at the surface of photosensitive drum 210 is uniformly charged by the charger 201 to the level shown in FIG. 9(*a*).

Next, light irradiation is conducted by first exposing means 202a depending on the picture information corresponding to the first color and the electrostatic latent image corresponding to the first color is formed on photosensitive medium 210a. A conventional exposing means may be used. Next, the first electrostatic latent image is visualized using a first developing means 203. This is done by supplying toner of the first color to photosensitive layer 210a which has the first electrostatic latent image which is formed by the first exposing means. A conventional developing means may be used as the first developing means. In this case, a developing bias is selected in accordance with whether regular developing or inverse developing is to be conducted.

Next, light irradiation is conducted for the picture information corresponding to the second color by using second exposing means 202b. The electrostatic latent image corresponding to the second color is thus formed on photosensitive layer 210a. A conventional exposing means and writing system may be used. Thereafter, to visualize the image, toner corresponding to the second color is supplied by second developing means 203b to photosensitive layer 210a which has the second electrostatic latent image formed by the second exposing means. In this case, the developing bias may also be selected in the conventional manner.

Pre-transfer corotron 209 is used to match or equalize with each other the polarities of the first and second toners deposited on photosensitive medium 210a before transfer, and it also may be omitted for the particular process. The first toner image and the second toner image are transferred to the recording paper by transfer corotron 204, but such transfer may also be done using a conventional means other than electrostatic transfer. The image is then fixed on the recording paper in the fixing part (not illustrated). The photosensitive medium, having passed the transfer part, enters the cleaning process conducted by preclean corotron 205, cleaner 206 and photo-precleaner 207 and is prepared for subsequent use.

The light irradiation means, document scanning means and optical system for focusing used in the generally-applied copy machine may be used as the first and second exposing means. Furthermore, various kinds of devices may be used such as an optical writing device which uses optical modulation depending on the picture information. Examples of such writing devices are laser writing devices, liquid crystal light valves consisting of a uniform light source or a liquid crystal micro-shutter or LED array. Optical fibers may also be used as desired, depending on the particular application.

In some cases, it is also possible to provide the second charging means before the second exposing means.

EXPERIMENT 4*a*

An example of the double-element developer to be used in the third embodiment is manufactured as follows.

Carrier:

A carrier with a density of 2.9 g/cm$^3$ and an average grain size of 40 $\mu$m was obtained by mixing a copolymer of styrene-n-butylmethacrylate having a density of 1.1 g/cm$^3$ with a cubic type magnetite having a density of 4.8 g/cm$^3$ in the proportions by weight of 20/80. The resulting raw materials were melted, kneaded and finally milled.

Toner:

A toner with average grain size of 9.8 $\mu$m was obtained by melting kneading resin of 92 parts by weight formed through graft polymerization of a low molecular weight polyolefin and a styrenebutylmethacrylate copolymer, and red color pigment of 8 parts by weight (for example, resolscarlet, manufactured by BASF AG) and then milling the kneaded materials.

Double-element developer:

The developer was obtained by mixing 90 parts by weight of the above 2.9 g/cm$^3$ carrier with 10 parts by weight of above toner.

Tests 1 to 3, explained below, were conducted using the color picture recording apparatus of FIG. 8.

Test 1

A drum made of an organic photoconductive material with an outer diameter of 84 mm was used as the photosensitive drum. The drum was charged uniformly to −1000V by the charger, as shown in FIG. 9(*a*). Next, an inverse exposure of the picture part was carried out using a He-Ne laser to form an electrostatic latent image having surface voltages of −300V for the exposed part and −1000V for the non-exposed part. Developing was conducted by the first developing means using the red color toner with a developing bias of −800V, as shown in FIG. 9(*b*). Thereafter, the regular exposure of the non-picture part was carried out by an exposing lamp to form an electrostatic latent image having a surface voltage of −1000V for the non-exposed part and −200V for the exposed part. The latent image was developed by the second developing means using the black color toner with a developing bias of −400V, as shown in FIG. 9(*c*). Other operating conditions were established as follows:

The moving speed of the photosensitive drum was set to 140 mm/sec. The developing roll used in the first developing means had a stainless steel sleeve with an outer diameter of 40 mm and an 8-pole symmetrical magnetizing roll with an outer diameter of 20 mm. The developing roll used in the second developing means was composed of a stainless steel sleeve with an outer diameter of 40 mm and an 8-pole magnetizing roll with an outer diameter of 20 mm to form a repulsion field in the developing nip region.

The double element developer consisting of the red toner and ferrite carrier particles having a density of 5.0 g/cm$^3$ and a grain size of 100 μm was used for the first developing means. Double-element developers consisting of the black toner and the following four kinds of carrier particles with their grain sizes of 40 μm were respectively used for the second developing means: (i) carrier particles with a density of 2.2 g/cm$^3$ obtained by dispersing magnetic powder into the resin binder, (ii) carrier particles with a density of 3.8 g/cm$^3$ obtained by dispersing magnetic powder into the resin binder, (iii) ferrite carrier particle with a density of 5.0 g/cm$^3$, and (iv) Fe carrier particles with a density of 7.2 g/cm$^3$.

The moving speed ($F_{Dev}$, in cm/sec) of developer used in the second developing means, the distance (h, in cm) between the photosensitive medium and developing roll and amount of transfer of developer on the developing roll (F, in g/cm$^2$) were as indicated in Table 1. In this case, the filling rate (D, in percent) of the toner was also as indicated in Table 1.

TABLE 1

| | (i) ρ = 2.2(g/cm) | | | | (ii) ρ = 3.8 | | | | (iii) ρ = 5.0 | | | | (iv) ρ = 7.2 | | | |
|---|---|---|---|---|---|---|---|---|---|---|---|---|---|---|---|---|
| | F | h | V Dev | D | F | h | V Dev | D | F | h | V Dev | D | F | h | V Dev | D |
| Testing 1 | 0.03 | 0.09 | 70 | 8.0 | 0.05 | 0.09 | 210 | 7.3 | 0.07 | 0.09 | 210 | 7.8 | 0.08 | 0.09 | 210 | 6.2 |
| (VPR = 140 mm/sec) | 0.05 | 0.09 | 210 | 12.6 | 0.05 | 0.09 | 280 | 14.6 | 0.13 | 0.12 | 210 | 10.8 | 0.08 | 0.09 | 280 | 12.3 |
| | 0.03 | 0.09 | 280 | 15.0 | 0.10 | 0.10 | 280 | 26.3 | 0.07 | 0.09 | 280 | 15.6 | 0.15 | 0.10 | 280 | 20.8 |
| | 0.05 | 0.09 | 280 | 25.3 | 0.11 | 0.09 | 280 | 32.2 | 0.13 | 0.12 | 280 | 21.7 | 0.15 | 0.09 | 280 | 23.1 |
| | 0.08 | 0.10 | 280 | 36.4 | 0.10 | 0.10 | 420 | 52.6 | 0.13 | 0.10 | 280 | 26.0 | | | | |
| | 0.05 | 0.09 | 420 | 50.5 | 0.11 | 0.09 | 420 | 64.3 | 0.07 | 0.09 | 420 | 31.2 | | | | |
| | 0.08 | 0.10 | 420 | 72.8 | | | | | | | | | | | | |
| Testing 2 | 0.03 | 0.09 | 80 | 8.0 | 0.05 | 0.09 | 240 | 7.2 | 0.07 | 0.09 | 240 | 7.8 | 0.08 | 0.09 | 240 | 6.2 |
| (VPR = 160 mm/sec) | 0.05 | 0.09 | 240 | 12.6 | 0.05 | 0.09 | 320 | 14.6 | 0.13 | 0.12 | 240 | 10.8 | 0.08 | 0.09 | 320 | 12.3 |
| | 0.03 | 0.09 | 320 | 15.0 | 0.10 | 0.10 | 320 | 26.4 | 0.07 | 0.09 | 320 | 15.6 | 0.15 | 0.10 | 320 | 20.8 |
| | 0.05 | 0.09 | 320 | 26.0 | 0.11 | 0.09 | 320 | 32.2 | 0.13 | 0.12 | 320 | 21.7 | 0.15 | 0.09 | 320 | 23.1 |
| | 0.08 | 0.10 | 320 | 36.4 | 0.10 | 0.10 | 480 | 52.6 | 0.13 | 0.10 | 320 | 26.0 | | | | |
| | 0.05 | 0.09 | 480 | 52.0 | 0.11 | 0.09 | 480 | 64.3 | 0.07 | 0.09 | 480 | 31.2 | | | | |
| | 0.08 | 0.10 | 400 | 54.5 | | | | | | | | | | | | |
| | 0.08 | 0.10 | 450 | 65.9 | | | | | | | | | | | | |

Here, the amount of transfer of developer used in the second developing means was changed by adjustment of the trimmer gap.

FIGS. 10 and 11 indicate the results of tests conducted with the varying filling rates of developer within the developing nip in the second developing means. In these figures, the line thickening rate and mixing rate of toner are evaluated in accordance with the following equations:

$$\text{Thickening rate (blur rate of line) (\%)} = \frac{[(\text{line width of toner image of first developing after passing second developing nip}) - (\text{line width of toner image of first developing before passing second developing nip})]}{(\text{line width of toner image of first developing before passing second developing nip})} \times 100 \quad 1.$$

-continued $$\text{Mixing rate of toner (weight \%)} = \frac{[(\text{weight of toner of first developing}) - (\text{weight of toner of first developing after passing second developing nip})]}{(\text{weight of toner of first developing})} \times 100 \quad 2.$$

Test 2

The processes were the same as those in Test 1, except that the double-element developer consisting of the red color toner and a carrier with a density of 2.2 g/cm$^2$ and a grain size of 40 μm obtained by dispersing magnetic powder into the binder resin was used as the developer in the first developing means. The result obtained was similar to that of Test 1.

Test 3

A Se system drum with outer diameter of 84 mm was used as the photosensitive drum, and was uniformly charged to 1000V with a charger, as shown in FIG. 12(*a*). Next, the exposure of the non-picture part ("regular exposure") was conducted with an exposing lamp to form an electrostatic latent image having surface voltages of 300V for the exposed part and 1000V for the non-exposed part. This latent image was then developed using the bias of 400V, as shown in FIG. 12(*b*). While the polarity of toner was kept to negative with the second charging means, the drum was charged uniformly to 900V, as shown in FIG. 12(*c*). The drum was then exposed to the picture part (reverse exposure) by LED to form an electrostatic latent image having the surface voltages of 900V for non-exposed part and 200V for the exposed part. The latent image was developed using black color toner with the second developing means under a developing bias of 700V, as shown in FIG. 12(*d*). In this case, other processing conditions were as follows:

The moving speed of the photosensitive drum was set to 160 mm/sec. A developing roll, consisting of the stainless steel sleeve with an outer diameter of 40 mm and an 8-pole symmetrical magnetizing roll with an outer diameter of 25 mm, was used in the first developing means. A roll consisting of a stainless steel sleeve with an outer diameter of 40 mm and an 8-pole magnetizing roll with an outer diameter of 20 mm and forming a repulsion magnetic field in the developing nip region was used in the second developing means.

In the first developing means, the double-element developer, consisting of the black color toner and the ferrite system carrier with a density of 5.0 g/cm$^3$ and a grain size of 100 μm, was used. In the second developing means, the double-element developer consisting of the red color toner and the same carrier as that used in Test 1 was used. The moving speed ($F_{DEV}$, in cm/sec) of developer used in the second developing means, the distance (h, in cm) between the photosensitive medium and developing roll and amount of transfer of developer on the developing roll (F, in g/cm$^2$) were as indicated in Table 1. In this case, the filling range (D, in percent) of the toner was also as indicated in Table 1.

The amount of developer transferred in the second developing means was changed by adjusting the trimmer gap.

FIGS. 13 and 14 indicate the results of tests conducted with varying filling rates of developer within the developing nip in the second developing means. These figures show the line thickening rate and the toner mixing rate evaluated in accordance with the already explained equations.

From the result, it is obvious that the developer filling rate in the developing nip in the second developing means should preferably be within the range of from 10% to 50%. Also, the carrier in the developer should have a density equal to or less than 4.0 g/cm$^3$ and should be formed from dispersing magnetic powder into the binder resin. In this case, the toner image is not damaged and the mixing of toner and the disturbance of the toner image can be controlled.

In the color picture recording method of the third embodiment of the present invention, repeated developing is carried out by the magnetic brush method using the double-element developer. Since the developer filling rate in the developing nip of the second developing means is set to a range of 10% to 50%, the toner image in the preceding stage is not disturbed, even during repeated developing, nor is the carry-over phenomenon generated. Therefore, the present invention provides a high quality color picture without disturbance.

The fourth embodiment of the present invention will be described with reference to FIGS. 15 to 19. The fourth embodiment is a color picture recording method, to which the present invention is applied. An important teaching of the fourth embodiment is that disturbance of the toner image can be further prevented by using a developing device wherein a developing main pole of a developing roll comprises a repulsion magnetic pole having a specific magnetic flux density.

A color picture recording method of the fourth embodiment of the present invention comprises: a latent image forming process to form an electrostatic latent image on the latent image carrier with a latent image forming means; a developing process to visualize the formed latent image by using toners of two or more different colors; and a transfer process for transferring the visualized color toner image after repeating several times at least the developing process of the latent image forming process and a developing process. A developing roll, consisting of a developing sleeve and magnet roll and having a magnetizing pattern in which the magnetic poles of the same polarity are adjacent to each other in the developing nip region and having a 500 Gauss or more magnetic flux density of the main pole for developing, is used at least to each other in the developing processes of the second and following trials among the plurality of times of the developing processes. Developing is conducted by depositing the double-element developer consisting of the toner and magnetic carrier with a density of 4.0 g/cm$^3$ or less on the developing sleeve. The carrier density $\rho$ is preferably in a range of 1.7 to 4.0 g/cm$^3$ and more preferably in a range of 1.7 to 3.0 g/cm$^3$.

The grain size of the low density carrier used in the present invention can be determined freely but the desirable average grain size is in the range of from 30 μm to 50 μm, based experimental results. The optimum average grain size is about 40 μm.

The magnetic brush developing device used in the developing process in the fourth embodiment of the present invention comprises a developing roll consisting of a magnetic roll having a plurality of magnetic poles, and a non-magnetic cylindrical sleeve provided on the circumference thereof. The developing roll used in at least the second or successive developing processes should preferably have a magnetizing pattern in which magnetic poles of the same polarity are adjacent to each other in the developing nip and the main pole for developing should have a 500 Gauss or more magnetic flux density. Moreover, it is also preferable for the developing roll to have a flux density difference of 200 Gauss or more between the maximum and minimum levels in the distribution of magnetic flux of the main pole for developing. It is particularly desirable to have a flux density difference of 350 to 500 Gauss. An example of a magnetic brush developing device of the fourth embodiment is shown in FIG. 17. Developing roll 311 comprises a developing sleeve 312 made of non-magnetic material and a magnet roll 313, and has a non-symmetrical 7-pole magnetizing pattern positioned in opposition to photosensitive drum 310. The main poles for developing consist of N2 and N3 which are adjacent to each other and form the repulsion magnetic field in the developing nip region as shown in FIG. 18. Element 314 is the magnetic brush or tipping part limiting member.

The magnetic brush is formed by depositing the double-element developer on the developing sleeve of the developing roll, and adjusting the magnetic brush or tipping part length with a conventional magnetic brush limiting member. The developing results from adhesion of toner to the latent image by rubbing, with the magnetic brush, the photosensitive medium surface, which is opposed to the magnetic brush, while moving the magnetic brush through the relative movement of the magnet roll and sleeve. In this case, the magnet roll is fixed and the sleeve is rotated. It is desirable that the moving speed of the surface is set equal to that of the photosensitive medium, namely that of the latent image carrier surface.

FIG. 15 is an example of a color picture recording apparatus which implements the image recording method of the fourth embodiment, in which the color picture is formed by formation of a latent image of two levels. The graphs of FIGS. 16(*a*)–(*c*) show the surface voltage of the photosensitive medium for various operating conditions during developing by the picture recording apparatus of FIG. 15. The color picture recording apparatus of FIG. 15 comprises charger 301, first exposing means 302*a*, first developing means 303*a*, second exposing means 302*b*, second developing means 303*b*, transfer corotron 304, preclean corotron 305, cleaner 306, optical precleaner 307, recording paper 308, pre-transfer corotron 309, photosensitive drum 310, and photosensitive layer 310*a*.

Turning now to the operation of color picture recording apparatus of FIG. 15, photosensitive drum 310 rotates in the direction of the arrow mark. First, photosensitive layer 310*a* at the surface of photosensitive drum 310 is uniformly charged by the charger 301, as shown in FIG. 16(*a*).

Next, light irradiation is conducted by first exposing means 302*a* according to the picture information corresponding to the first color, thereby forming an electrostatic latent image corresponding to the first color on the photosensitive medium. A conventional type of exposing means may be selected. Next, the first electrostatic latent image is visualized using a first developing means 303*a*, by supplying toner of a first color to photosensitive layer 310*a* which has the first electrostatic latent image formed by the first exposing means, as shown in FIG. 16(*b*). A conventional developing means may be used as the first developing means. In this case, the developing bias is selected according to whether regular developing or inverse developing is to be conducted.

In succession, light irradiation is conducted according to the picture information corresponding to the second color, using second exposing means 302*b*. The electrostatic latent image corresponding to the second color is formed on the photosensitive layer 310*a*. Conventional exposing means and writing systems may be used. To visualize the image, the toner corresponding to the second color is then supplied by second developing means 303*b* to photosensitive layer 310*a*, which has the second electrostatic latent image formed by the second exposing means, as shown in FIG. 16(*c*). In this case, the developing bias may be selected in the conventional manner.

Pre-transfer corotron 309 is used to match or equalize with each other the polarities of the first and second toners deposited on the photosensitive medium before transfer and it also may be omitted for a particular process. The first toner image and the second toner image are transferred by transfer corotron 304 to the recording paper but such transfer may also be done using means other than electrostatic transfer. The image is then fixed on the recording paper in the fixing part (not illustrated). The photosensitive medium, having passed the transfer part, enters the cleaning process conducted by preclean corotron 305, cleaner 306 and photo-precleaner 307, which prepares the medium for subsequent operation.

A light irradiation means, document scanning means and optical system for focusing may be used as the first and second exposing means. Various kinds of devices such as an optical writing device which uses optical modulation depending on the picture information, for example, a laser writing device, a liquid crystal light bulb consisting of a uniform light source and a liquid crystal micro-shutter, LED array, or optical fiber may be used depending on the specific application.

In some cases, it is also possible to provide a second charging means before the second exposing means.

EXPERIMENT 5

An example of the double-element developer to be used in a fourth embodiment of the invention is manufactured as follows.

Carrier:

A carrier with a density of 2.9 g/cm$^3$ and an average grain size of 40 μm was obtained by mixing a copolymer of styrene-n-butylmethacrylate having a density of 1.1 g/cm$^3$ with cubic type magnetite having a density of 4.8 g/cm$^3$ in the proportions by weight of 20/80, then melting and kneading the raw materials and milling the resulting materials.

Toner:

Toner with an average grain size of 9.8 μm was obtained by melting and kneading resin of 92 parts by weight obtained through a graft polymerization of a low molecule polyolefin and a styrenebutylmethacrylate copolymer and red color pigment of 8 parts by weight (for example, resolscarlet, manufactured by BASF AG), and then milling such kneaded materials.

Double-element developer:

The developer was obtained by mixing 90 parts by weight of the carrier and 10 parts by weight of the toner.

The result of tests conducted using the color picture recording apparatus shown in FIG. 15 are explained below.

A Se system drum was used as the photosensitive drum. The drum was charged uniformly to 1100V by the charger. Next, an inverse exposure, i.e., exposure of the picture, was carried out using a He-Ne laser to form an electrostatic latent image having surface voltages of 200V for the exposed part and 800V for the non-exposed part. Developing was conducted using the red color toner by the first developing means under a developing bias of 650V. Thereafter, a regular exposure, i.e., exposure of the non-picture part, was carried out by an exposing lamp to form an electrostatic latent image having a surface voltage of 750V for the non-exposed part and 100V for the exposed part. The latent image was developed using the black color toner by the second developing means under a developing bias of 250V. In this case, other operating conditions were established as follows.

The surface line moving speed of the photosensitive drum was set to 50 mm/sec. The carrier of the double-element developer used by the first and second developing means was obtained by dispersing the magnetic powder into the binder resin to have a density of 3.0 g/cm$^3$ and an average grain size of 40 μm.

In test 1, the developing roll in the first developing means was a 6-pole symmetrical magnetization roll, and the magnetic flux density of the main pole magnet was 800±50 Gauss. The developing roll in the second developing means was a non-symmetrical 7-pole magnetizing roll as shown in FIG. 17, having a surface moving line speed of 50 mm/sec. The surface magnetic flux density of the main pole magnet N2 and N3 of the developing roll of the second developing means was 1200±50 Gauss, and the magnetic flux difference between the maximum and minimum levels formed by N2 and N3 were 500 Gauss. The magnetic flux density of other poles was 800±500 Gauss.

For comparison, test 2 was conducted in the same manner as explained above, except that an iron system carrier having a density of 7.8 g/cm$^3$ and an average grain size of 60 μm as the carrier of double-density developer was used in the second developing means.

Test 3 was conducted in the same manner as explained above, except that an iron system carrier with a density of 7.8 g/cm$^3$ and an average grain size of 60 μm was used as the double-element developer carrier, a 6-pole symmetrical magnetization developing roll having a main pole surface magnetic flux density of N2 =800 ±50 Gauss, as shown in FIG. 19 was used as the developing roll in the second developing means, and the surface moving line speed of the developing roll was set to 150 mm/sec. In this case, the developing roll speed was increased by a factor of three so that the similar developing concentration to that of the repulsion magnetic field could be obtained.

Test 4 was conducted in the same way as test 1, except that the surface magnetic flux density of the main pole magnet N2 and N3 of the developing roll in the second developing means was 300 ±50 Gauss and the level difference between the maximum and minimum levels formed by N2 and N3 was 100 Gauss.

The results of these tests are indicated in the following table. In this table, the circle O means NO (does not exist), the cross x means YES (exists) and the triangle Δ means possible for practical use but does not prevent picture quality from being deteriorated.

| | Deterioration of picture of 1st developing | | Deterioration |
|---|---|---|---|
| Test No. | Disturbance of picture | Deterioration of picture concentration | of picture concentration of 2nd developing |
| 1 | O | O | O |
| 2 | O | Δ | O |
| 3 | Δ | X | O |
| 4 | O | O | Δ |

As is obvious from the indicated results, deterioration of the developing capability may be prevented and reduction of scratching of the toner image already formed may also be made by using a developing roll, in the second developing process, which has magnetic poles in repulsion in the developing nip region. In this case, it is preferred that the magnetic flux density of the repulsion poles in the developing nip should be 500 Gauss or more. Sufficient developing capability can be attained where the difference between the maximum and minimum magnetic flux distribution levels in the developing nip is 200 Gauss or more. Deterioration of the toner image during the first developing may be greatly reduced by using, in combination with the developing roll, a double-element developer containing the magnetic carrier with a density of 4.0 g/cm$^3$ or less.

In the color picture recording method of the fourth embodiment, in which repeated developing is conducted by the magnetic brush method using the described developing roll and double-element developer, the toner image in the preceding stage is not disturbed, even during repeated developing, and carry over phenomenon is not generated. Accordingly, a high quality color picture, without any disturbance of the picture, may be obtained by practice of the embodiment.

The image recording method of the present invention described with the first through the fourth embodiments can also be applied to the fifth embodiment of the invention as shown in FIGS. 20 to 23. The fifth embodiment provides a color recording method which realizes reduction in size of a device and high speed copying operation and moreover improves picture quality by preventing lack of portions of picture and lowering of concentration.

The fifth embodiment of the present invention is a color recording method characterized by charging a photosensitive medium, forming a first electrostatic latent image by exposing the photosensitive medium, forming a first toner image by developing the electrostatic latent image, and forming a second electrostatic latent image by exposing the toner image on the photosensitive medium. This second latent image is developed using a toner of a color different from the color of the first toner image and using a relationship of respective voltages of $|V_b-V_c| \pm |V_a-V_c|$, where $V_a$ is the non-picture part voltage, $V_b$ is first toner image voltage and $V_c$ is developing bias voltage of second developing device.

In above method, the photosensitive medium is first charged, then exposed to form the first electrostatic latent image. This latent image is developed to form the first toner image. Moreover, the second electrostatic latent image is formed by a second exposure. In this case, the operating conditions of respective parts of the apparatus are first set so that the voltage difference between the first toner image voltage $V_b$ and the developing bias $V_c$ of the second developing device is equal to or higher than the voltage difference between the non-picture part voltage $V_a$ and the voltage $V_b$ of the first toner image. The electrostatic adhesive force of the toner to the photosensitive medium is, therefore, enhanced and the first toner is no longer scratched out easily by the second developing device.

FIG. 21 shows a preferred example of an apparatus for practicing the color recording method of the fifth embodiment.

The apparatus of FIG. 21 comprises a preclean corotron 402, cleaning device 403, charger 404, first developing device 405, second developing device 406, a pretransfer corotron 414, and a transfer device 408 at the external circumference of photosensitive medium 401. Moreover, a first exposing part 410 is provided between the first charger 404 and the first developing device 405, and a second exposing part 420 is provided between the first developing device 405 and the second developing device 406. The recording paper 412 is sent from the paper feed tray 416, passes between the transfer device 408 and the photosensitive medium 401 and exits through fixing device 413.

First exposing part 410 and second exposing part 420 of this apparatus use an optical focusing system having a mirror and lens system, and an optical writing device such as a laser diode array, light emitting diode array, liquid crystal shutter array or a fluorescent lamp display element array, etc.

The color recording system of the fifth embodiment will now be explained with reference to FIGS. 20(*a*)-20(*e*). In FIGS. 20(*a*)-20(*e*), the figures lettered (*a*) to (*e*) indicate changes of voltage in respective portions of photosensitive medium 401 in the method of the fifth embodiment. The recorded picture contains a white region (W), black region (B) and red region (R) as indicated in the boxes in the upper part of figure.

First, the photosensitive medium 401 is uniformly charged by the first charger 404 as shown by FIG. 20(*a*). Next, photosensitive medium 401 is negatively exposed by the first exposing part 410. This discharges photosensitive medium 401 up to voltage V1 in the region corresponding to black region B. Red region R is kept at the initially charged voltage V0, as shown in FIG. 20(*b*). Next, a developing bias V2 is set between the electrostatic latent image voltage V1 of black region B and the initially charged voltage V0, and developing is carried out using the positively charged black color toner with first developing device 405, as shown in FIG. 20(*c*).

The second electrostatic latent image corresponding to red region R is then formed by positive exposure at second exposing part 420, as shown by FIG. 20(*d*). In this case, the region other red region R is discharged up to the rather negative side than the voltage Vb of the surface of first toner image. The voltage after the discharging is called the non-picture part voltage $V_a$. Red region R is then developed using the negatively charged red toner by second developing device 406, as shown by FIG. 20(*e*). In this case, the developing bias voltage $V_c$ of the second developing device is set to the intermediate voltage of the non-picture part voltage $V_a$ and the electrostatic latent image voltage V3 of red region R. The double-color toner images are thus formed on the photosensitive medium 1 and these toner images are transferred to recording paper 412. Before this transfer, both black toner and red toner are charged in the same polarity by pre-transfer corotron 414. This method does not allow lowering of the copying speed and has the advantage of not requiring high accuracy registration. In the generally-applied method, however, on the occasion of forming the electrostatic latent image, the exposing is generally conducted, as indicated in FIG. 20(*f*) in such a manner that the voltage $V_b$ of first toner image is in the more negative side than the non-picture part voltage $V_a$ after the discharging.

Advantages obtained by the method of the fifth embodiment indicated in FIGS. 20(*a*) to 20(*e*) will be explained on the basis of the results of experimental test.

FIG. 22 shows the result of evaluation for disturbance of the first toner image with image disturbance ranks, the disturbance having occurred on a belt-shaped first toner image 421 which has been formed on the photosensitive medium 401 to extend in a direction parallel to its rotating axis and after it is sent to the second developing device. Disturbance of the image appears mainly in the circumferential direction (direction of the arrow 422) of the photosensitive medium. However, in case the rotating speed of the developing brush of the second developing device is higher than the circumferential speed of the photosensitive medium, the image is disturbed in a forward direction. When the rotating speed is lower than the circumferential speed, the image is disturbed in a backward direction. The evaluation ranks are determined as follows: nodisturbance is ranked as "0", acceptable disturbances as "1" and a fault as "2" or more.

In the graph of FIG. 22, image disturbance is evaluated by changing a value of $|V_a-V_c|$ for the four kinds of conditions from 100 V to 400 V of a value of $|V_b-V_c|$. In this evaluation experiment, the first charging voltage was set to +800 V, the first developing bias to +650 V, the second developing bias to +400 V, and the non-picture part voltage Va was changed by changing the amount of second exposure.

From the vertical axis, the range of which the evaluation is "1" or less (the range where the picture is of good quality) satisfies the conditions $|V_b-V_c| \geqq |V_a-V_c|$. It means, as already explained, that the charging voltage and exposing voltage should preferably be selected so that the relation shown in FIG. 20(*e*) may be obtained. This is because an electrostatic attracting force of toner to the photosensitive medium is thereby enhanced. When the first toner image enters the second developing device, the phenomenon whereby the first toner image is captured by the second developing brush and is developed again in the second development is no longer easily generated under these conditions.

In the case of Experiment:

Photosensitive medium
- Selenium (Se) system photosensitive medium
- Drum diameter: 200 mm First developer
- Double-element system (positively charged black toner)
- Carrier: Ferrite system carrier with average grain size of 100 μm
- Black toner: 92 parts by weight of Styrene-n-butylmethacrylate copolymer, 8 parts by weight of carbon black #4000 (Trade Name, produced by Mitsubishi Kasei), and 2 parts by weight of a charging control agent (Bontron P-51, Trade Name, produced by Orient Chemicals) are mixed, melted and kneaded. Thereafter this material is milled into fine particles with an average grain size of 12 μm. It is charged positively against the carrier.

Second developer:
- Double-element system (negatively charged red toner).
- Carrier 35 parts by weight of Styrene-n-butylmethacrylate and 65 parts by weight of magnetite are mixed, melted, kneaded and milled.
  - Magnetic powder dispersion type.
  - Average grain size is 30 μm with a density of 2.2 g/cm$^3$.
- Red toner: 92 parts by weight of styrene-n-butylmethacrylate copolymer, 8 parts by weight of red color pigment Lithor Scarlet (Trade Name, produced by BASF), and 2 parts by weight of charging control agent E-84, (Trade Name, produced by Orient Chemicals) are mixed, melted, kneaded and milled to an average grain size of 12 μm. It is charged negatively against the carrier.

Process speed: 150 mm/sec.

Developing parameter
(First developing device, second developing device)
- TG (trimming gap): 0.9 mm
- DRS (drum roll space): 1.0 mm
- MSA (magnetic pole inclination): +5 deg.
- Vd (developing roll rotating speed): 450 mm/sec
- Main pole of magnetic poles: 650 Gauss
- Rotation of developing roll: WITH (forward direction with the photosensitive medium).

In the above description, the photosensitive medium is positively charged by each charger but the similar effect can also be obtained by using a negatively charged photosensitive medium. Moreover, the developing system of each developing device may be selected in the conventional manner.

For example, a negative-positive exposing method is employed in the above description but a similar effect can be attained using positive-negative exposing, positive-positive exposing and negative-negative exposing methods.

FIG. 23(*a*) shows another example of the color recording method of the fifth embodiment, utilizing the positive-negative exposing method. In this case, after positive exposure and developing, the photosensitive medium is once uniformly charged to set the non-picture part at voltage $V_a$ before negative exposure. In comparison of the developing bias $V_c$ of the second developing device and the voltage of each part, FIG. 23(*a*) satisfies the relationship, $|V_b-V_c| \geqq |V_a-V_c|$. On the other hand, FIG. 23(*b*) shows the relationship $|V_b - V_c| \geqq |V_a - V_C|$. From this fact, disturbance of the toner image may be further prevented by setting the voltages of respective portions as indicated in FIG. 23(*a*).

According to the color recording method of the fifth embodiment previously explained, the first toner image cannot enter the second developing device to come into contact with the developing brush. Therefore, disturbance of the image can be effectively prevented. Migration of toner and lack of the recorded picture may thereby be prevented and high speed and high quality color recording may be accomplished.

Furthermore, the image recording method of the present invention also may be applied to a sixth embodiment shown in FIGS. 24 to 30. The sixth embodiment of the present invention will now be described. The sixth embodiment provides a copying apparatus which realizes the copying through color separation with comparatively simplified structure without deterioration of the picture quality of the black color picture, and which realizes scale magnification and reduction of the copied picture while maintaining high picture quality.

The sixth embodiment is a copying apparatus comprising a picture reading device which reads a picture on an original document and converts it into an electrical picture signal; an optical output device which forms a first electrostatic latent image on a photosensitive medium corresponding to the particular color element signal in the picture signal from the picture reading device; an optical focusing system which guides an optical image, corresponding to a color element other than the particular color in the picture on the original document, to the photosensitive medium and thereby forms a second electrostatic latent image; a first developing device which develops the first electrostatic latent image with a toner of a first color; a second developing device which develops a second electrostatic latent image with a toner of a color other than the first color; and a transfer device which transfers the toner to a copying paper after developing by the first developing device and second developing device. The optical focusing system comprises a mirror and a lens to guide the optical image of a freely selected copying magnification to the photosensitive medium, the light being divided into two directions after passing through the lens. One light beam enters the picture reading device, and the other light beam enters the photosensitive medium to form the second electrostatic latent image after passing the optical focusing system. A filter passing the particular color is provided to be movable away from and into the incident optical path of the light beam to the picture reading device.

The optical focusing system may be an analog optical device to directly guide the optical images to the photosensitive medium, using a mirror and a lens.

The copying apparatus of the sixth embodiment forms electrostatic latent images on a photosensitive medium using an optical output device for a particular color, and an optical focusing system for colors other than the particular color. These electrostatic latent images are respectively developed by individual developing devices using developers for different colors. For instance, in the case where an electrostatic latent image corresponding to a black color picture is formed using an optical focusing system, such electrostatic latent image is developed by the black color toner. The electrostatic latent image corresponding to the picture of a particular color formed by the optical output device is developed by the toner of such color or using a freely selected desired color. Toner images of double colors are formed on the photosensitive medium and these are transferred at one time to the copying paper.

In this case, the light, which has passed the lens for magnifying and reducing the optical image, is separated into two beams in the optical focusing system. One beam enters the picture reading device while the other enters the photosensitive medium from the optical focusing system. Therefore, the electrostatic latent image formed by the optical focusing system matches the electrostatic latent image formed by the optical output device driven on the basis of the picture signal output from the picture reading device. The light entering the picture reading device enters, for example, through a filter by the first scanning and also enters without filtering by the second scanning. For example, the light enters into the picture reading device through a filter at the first scanning, and enters the device without passing through a filter at the second scanning.

The particular color element can be extracted by comparing the light entering by the first scanning and the light entering by the second scanning. The filter is movable into and out of the light path as explained above.

FIG. 24 shows an example of the copying apparatus of the sixth embodiment.

The apparatus of FIG. 24 comprises a platen glass 502 on which an original document 501 is placed, a lamp 506 which irradiates the original document, an optical focusing system 507 comprising a mirror 507*a* which guides optical image corresponding to a picture on the original document, half mirror 507*b* and lens 507*c*, an optical filter 508 inserted between this optical focusing system 507 and photosensitive medium 509*a*, a picture reading device 505 which receives through movable filter 505*a* the light which has passed through half mirror 507*b* and a signal processing circuit 522 which processes the picture signal obtained by reading the optical image with the picture reading device 505. This movable filter 505*a* is, for example, a filter which transmits red color and is provided to be movable by means of a drive mechanism (not shown) into and away from the light path leading the light to picture reading device 505.

The photosensitive drum 509, having the photosensitive medium 509*a* at the circumference thereof, is supported so that it is rotatably driven in the direction indicated by the arrow mark 509*b*. At the circumference of the drum, there are provided a first charger 510, a first developing device 511, a second charger 512, an optical output device 513, a second developing device 514, pre-transfer corotron 515, a transfer device 516, a peeling corotron 517, a preclean corotron 519, a cleaning device 520 and a discharging lamp 521. The picture signal output from the picture reading device 505 is processed by the signal processing circuit 522 which is connected with optical output device 513 so that device 513 is driven in accordance with the signal of the particular color element in the picture signal. The connecting path between this signal processing circuit 522 and optical output device 513 is omitted in the drawing.

This apparatus is also provided with a paper feeding tray 524 which accommodates copying paper 525, a paper feed roller 526, a transmitting roller 527, a transmitting belt 528, a fixing device 529 and a discharged paper tray 530.

This apparatus forms two kinds of electrostatic latent images on photosensitive medium 509a, using optical focusing system 507 and optical output device 513. In the sixth embodiment, the electrostatic latent image formed by optical output device 513 is called the first electrostatic latent image, and the electrostatic latent image formed by optical focusing system 507 is called the second electrostatic latent image.

In this example, an optical image guided by optical focusing system 507 reaches photosensitive medium 509a through optical filter 508 which transmits a light beam of red color. The red color light reflected by the red color portion of the picture on the original document reaches photosensitive medium 509a at an intensity near to the white color beam reflected from the white picture part of the background. Therefore, if a so-called "positive writing" is applied, the electrostatic latent image corresponding to the red color picture is not-formed, i.e., discharged like the background, and the electrostatic latent image corresponding to the picture of the other color is formed.

The picture signal read by picture reading device 505 enters signal processing circuit 522, and only the signal corresponding to the red picture color is extracted from the picture signal. Optical output device 513 is driven by the extracted signal and the electrostatic latent image corresponding to the red color picture is formed on photosensitive medium 509a by so-called "negative writing."

Picture reading device 505 is a single-dimension image pickup element consisting of a CCD (Charge Coupled Device) and is used as an ordinary image sensor for reading a monochrome picture. The apparatus of the sixth embodiment scans the picture on the original document once with picture reading device 505 to read the optical image which has passed through movable filter 505a, which transmits the red color. This signal is stored, and in the case of a second trial of scanning, the optical image is directly read by picture reading device 505, with filter 505a being moved away from the optical path. The red color element is extracted through comparison between the directly read signal and the signal stored previously.

Signal processing circuit 522 compares the picture signal obtained through movable filter 505a with the picture signal obtained directly without passing through the filter, for every picture element, to judge whether each picture element is red or not. When the element is judged to be red in color, circuit 522 causes a light emitting element of optical output device 513 to emit light in order to discharge the photosensitive medium. In this case, since negative writing is employed, the picture element of red color can be developed with the red color toner.

Various kinds of well known devices, such as a light emitting diode arrays, liquid crystal microshutter arrays, phosphor display tube arrays, magnetic optical shutter arrays and semiconductor laser scanners may be used as optical output device 513.

In order to form a first electrostatic latent image formed by optical output device 513 and a second electrostatic latent image formed by the optical focusing system with registration, the sixth embodiment employs the following method for formation and developing of the latent image.

The following operations are explained with reference to FIGS. 24 and 25. In FIG. 24, when the platen glass 502 on which the original document 501 is placed is moved in the direction indicated by arrow mark 531, the first electrostatic latent image and the second electrostatic latent image are formed on photosensitive medium 509a as previously explained under the discussion of two kinds of electrostatic latent images.

Photosensitive medium 509a rotates in the direction indicated by arrow mark 509b in synchronization with transfer of the platen glass 502. Photosensitive medium 509a is first subjected to the cleaning of its surface with preclean corotron 519 and cleaning device 520 and is then discharged to remove unwanted charge with discharge lamp 521. Next, photosensitive medium 909a is primarily charged, as shown by FIG. 25(*a*), up to about 1000V with first charger 510. Next, the second electrostatic latent image is formed by optical system 507, the red color part and white color part are discharged, for example, to 100 V to 150 V, and the surface voltage of the black color part is kept at about 900 V, as shown in FIG. 25(*b*). This electrostatic latent image is developed by developing device 511.

Developing device 511 develops the electrostatic latent image in the first developing process using the black color toner of negative polarity, as shown by FIG. 25(*c*). In this case, the developing bias is selected to 200V. Next, second charger 512 charges again the surface of photosensitive medium 509a up to 600 V, as shown by FIG. 25(*d*). For this purpose, a conventional corotron is used.

Next, the first electrostatic latent image is formed by optical output device 513. In this case, the part corresponding to the red color picture is discharged and the surface voltage thereof becomes 100 V, as shown by FIG. 25(*e*). Developing device 514 then reversely develops such electrostatic latent image using the positive red color toner, as shown by FIG. 25(*f*). In this case, a 500 V developing bias is selected. In this embodiment, developing device 511 corresponds to the second developing device, while developing device 514 corresponds to the first developing device.

Toner images of black color and red color are thus formed on photosensitive medium 509a and these toner images are set to positive by pre-transfer processing corotron 515, as shown by FIG. 25(*g*). Copying paper 525 is sent by paper feed roller 526 from paper feed tray 524 and is then sent to transfer device 516 by transmit roller 527. Toner images of double color are transferred at one time to copying paper 525. The paper is then peeled by peeling corotron 517 and is sent to fixing device 529 by transmit belt 528. Finally, copying paper 525, which has completed the fixing process by fixing device 529, is ejected to exit tray 530.

In the case of the above process, the double-color picture is transferred at one time, resulting in an advantage that highly accurate registration of copying paper is not required. This differs from the case where the double-color picture is copied onto the copying paper with registration by twice repeating the transfer of the picture. Because the electrostatic latent image of the black color picture is formed by the optical focusing system, a high picture quality similar to that of the existing copying apparatus can be guaranteed.

As shown by way of example and not as a limitation, movable filter 505a of FIG. 26, located in front of picture reading device 505, moves in a direction forming a right angle against optical path 532, i.e., in the direction indicated by arrow mark 533. Filter 505a is set in light path 532 at the time of first scanning and is then moved backward at the time of the second scanning.

FIG. 27 is a second example of movable filter 505a. In this example, red filter 505a1, green filter 505a2, blue filter 550a3 and gray filter (ND filter) 505a4 are respectively provided radially around rotating axis 534. In this case, extraction of the color elements of the three colors, red, green and blue, can be effected by rotating filter 505a.

Practical Example of Picture Signal Processing

FIG. 28 is a block diagram of a picture signal processing circuit which irradiates an original document 501 using lamp 503, receives first the reflected light through a red color filter 505a by picture reading device 505, later receives the reflected light directly with picture reading device 505, and finally drives optical output device 513 to form an electrostatic latent image corresponding to the red color of the picture on photosensitive medium 509a. The operation thereof is controlled by a microprocessor (not illustrated.)

The picture signal, which has been photoelectrically converted by picture reading device 505, is amplified by amplifier (AMP) 541. The signal is then converted into a digital signal by analog to digital (A/D) converter 542, and output fluctuations can be corrected by well known shading correction circuit 544.

Multiplier 545 adjusts level differences of signals generated due to sensitivity difference of picture reading device 505 whether red color filter 505a is inserted or not. The correction coefficient is supplied from gain correction coefficient circuit 546.

First, when the signal of red color content, having passed through red color filter 505a, is read by the first scan, such signal is stored in memory 552. Memory 552 is a page memory for storing the signal for one display screen. The first scan is intended to store red color signal 545b, and photosensitive drum 509, as shown by FIG. 24, does not rotate.

Next, when the second scan is started, photosensitive drum 509 of FIG. 24 starts to rotate and formation of the second electrostatic latent image by optical focusing system 507 is started.

Simultaneously, picture reading device 505 starts to read the reflected light which is directly incident to device 505 from the original document. The resulting monochrome picture signal 545a is processed, in a manner similar to red color signal 545b, by AMP 541, A/D converter 542, shading correction circuit 544 and multiplier 545. The signal is then output to comparator 547a.

At the same time, red color signal 545b, stored in memory 552, is read and is then output to comparators 547a and 547b. The levels of red color signal 545b and monochrome signal 545a are compared by comparator 547a. This comparator provides a high level output when red color signal 545b is higher in level than monochrome signal 545a. Red color signal 545b is also compared with the reference value output from gray level coefficient circuit 548 in comparator 547b. This circuit is provided considering that the red color picture of a concentration higher than the constant level should be copied as a black color picture. Therefore, when the red color signal has a concentration higher than the constant level, comparator 547b provides an output of a low level.

AND circuit 549 sends a high level signal for copying the red color picture to memory 551 when both outputs of comparators 547a and 547b are at a high level. Memory 551 stores the picture signal of one line of output from picture reading device 505 and sends such signal to drive optical output device (LED ROS) 513 according to a predetermined time sequence.

In the above process, the red color signal element is extracted from the picture signal and the first electrostatic latent image is formed corresponding to such red color signal element.

As explained above, the copying apparatus of the present invention reads an optical image with picture reading device 505, as shown by FIG. 24, during a first scan. Then, the apparatus forms the first and second electrostatic latent images simultaneously on photosensitive medium 509a of FIG. 24 during a second scan.

The scans are not always required to be conducted in the same direction. The first scan may be done as a back-scan while the second scan may be done as a fore-scan. In this case, the scanning speed for both the fore-scan and the back-scan are set equal to each other. In some conventional copying apparatus, pre-scanning of the original document is done once before the copying process, to automatically adjust the exposure. In such an apparatus, the reading operation by the picture reading device is also conducted during such pre-scanning. In this case, the sixth embodiment can be practiced with the same operations.

For continuous copying of two or more sheets from the same original document, a single scan is always required for formation of the second electrostatic latent image by the optical focusing system in order to produce the copy on a sheet of paper. However, since the read signal by the picture reading device is already stored in the memory, second and successive scans are no longer required.

Scale magnification or reduction are frequently needed while copying. In this case, a zoom type lens 507c, is used for optical focusing system 507 to directly magnify or reduce the optical image, and the corresponding second electrostatic latent image is formed. On the other hand, the picture signal read by picture reading apparatus 505 is processed for scale magnification or reduction in signal processing circuit 522, if the signal is read through the optical system independently of such focusing system and the processed signal then drives the optical output device.

In the copying apparatus of the sixth embodiment, the optical image which has passed through lens 507c and is already magnified or reduced is guided to picture reading device 505, through half-mirror 507b. As may be obvious from FIG. 24, the optical image guided to photosensitive medium 509a is the same as the optical image entering the light receiving surface of picture reading device 505 through half-mirror 507b. This prevents deviation being generated due to registration. In this case, signal processing circuit 522 is required only to process the readout signal in order to drive optical output device 513, without complicated magnification or reduction processing for the signal. Because the density of readout picture of picture reading device 505 is usually less than that of optical output device 513, a circuit for adjusting such picture density is required.

In case the picture of original document 501 is read by picture reading device 505 using an individual light source, additional space is required. But this device also has an advantage that it can be reduced in size. The characteristics of half-mirror 507b, which is provided in optical focusing system 507 and separates the light into a pair of paths, will now be further explained.

FIG. 29 is an example of the characteristic diagram of a means (half-mirror) to separate light having passed lens 507c, suitable to practice this example. This half-mirror has a structure such that a nonmetallic evaporated film is deposited on float glass and shows a loss of only 5%. The transmission rate, T, of the incident light having an incident angle of 19 degrees is about 50% and a flat characteristic is obtained for entire part of the visible light spectrum In case there is a difference between the sensitivity of photosensitive medium 509a of FIG. 24 and that of picture reading device 505 of FIG. 24, it is desirable to make adjustment by changing the reflectivity by altering the characteristics of the evaporated film.

Vacuum-deposition of a metal film such as aluminum (A1) on float glass will also produce a half-mirror, but results in losses of 20% and higher depending on wavelength. A flat transmission rate versus wavelength for the half-mirror is not necessary in the copying apparatus of the sixth embodiment. However, in the case where the second electrostatic latent image is formed on photosensitive medium 509a of FIG. 24 by optical focusing system 507 of FIG. 24, the light should contain the appropriate color element. Since the light entering picture reading device 505 should also include the particular color element for subsequent extraction of the particular color element, it is most desirable that the half-mirror's dependency on wavelength be flat in the sensitivity region of picture reading device 505 and that of photosensitive medium 509a.

In the example of FIGS. 24 and 25, the picture on the original document is separated into a black color element and a red color element, and these are respectively developed by the black toner and red toner. It is also possible to obtain the copied picture combining desired colors by changing the color of the toner used in each developing device. The black picture may be developed by a blue toner. Moreover, optical filter 508 may be changed to filter another color. Also, if the signal of the color element extracted from the picture signal can be selected freely in signal processing circuit 522 and the colors of the toners in developing devices 511 and 514 can be selected freely, not only the original document of double-color of black and red but also a double-color document of black and blue or black and green can be chosen.

FIG. 30 is another example of a copying apparatus having such functions. This copying apparatus supports switching for three kinds of modes to extract blue and green color elements in addition to the red color element in signal processing circuit 522. The circuit structure thereof is the same as that indicated in FIG. 28 and therefore a detailed explanation is omitted here. Three types of color filters 508a, 508b, 508c, 505a, 505b, 505c, which can be selected by rotation are provided immediately before optical focusing system 507 and picture reading device 505. Filters 508a and 505a are red color filters, filters 508b and 505b are blue color filters and filters 508c and 505c are green color filters. Three developing devices 514a, 514b and 514c are provided for developing the first electrostatic latent image formed by optical output device 513. Red, blue and green toner are used by devices 514a, 514b, and 514c, respectively.

In an apparatus having such structure, for example, suppose that the picture on original document 501 is printed by double colors of black and blue. Signal processing circuit 522 is instructed to extract the blue color signal. A blue color filter 508b is inserted in optical system 507 and a developing process using blue color toner is carried out by operating only developing device 514b. The double-color copied picture of black and blue colors may be obtained as explained above.

For successful copying of the picture combining various colors, it is desirable for lamp 506 to be a 3-wavelength type, daylight type, or white color type fluorescent lamp, or a xenon lamp which cover the spectrometric sensitivity region for irradiating the original document.

According to the copying apparatus of the sixth embodiment explained previously, double-color electrostatic latent images are formed on the photosensitive medium by the optical focusing system and picture reading device. These images are individually developed by the toners of two colors and are transferred at one time to copying paper. Therefore, the transfer process to the copying paper can be completed by only a single transfer, thus, high precision registration is not required. In addition, the electrostatic latent image is formed using an optical focusing system for the principal color element, such as black, which results in high quality copies, even during scale magnification and reduction.

Such a two-color copying apparatus in black plus one color of the sixth embodiment is useful when the original document has a majority of black picture. Except for particular cases, commonly encountered multi-color original documents contain mostly characters or figures in black and underlines or marks in red as the minority of the other colors.

The image recording method of the present invention can be further applied to the seventh embodiment shown in FIGS. 31(a) to 48(c). The seventh embodiment is based on the principles of the previously described fifth embodiment.

The seventh embodiment relates to a method of and apparatus for forming images of two types by using electrostatic latent images, and more particularly, to an improved method and apparatus for forming an image in which, after latent images of two types are superposed on a latent image holder using superposition development, the developed images are simultaneously transferred to a transfer medium.

As shown in FIG. 31(a), the seventh embodiment provides an image forming method which comprises a first toner image formation process A; a second toner image formation process B; and a transfer treatment process C. First toner image formation process A forms a first toner image by forming a first latent image which corresponds to a first image and which is the result of one of the normal development and reverse development of the first latent image on a latent image carrier. The first latent image is developed by a first toner charged to one polarity. Second toner image formation process B forms a second toner image by forming a second latent image which corresponds to a second image. The second latent image is the result of the other one of the reverse development and normal development of the second latent image on the latent image carrier, and the developing of the second latent image by a second toner charged to the other polarity by magnetic brush development while applying a developing bias. Transfer treatment process C simultaneously transfers the first and second toner images to a transfer medium. The developing bias VB2 satisfies the following equations (1) and (2):

$$|VT1-VB2| > |VH2-VB2| \ldots \quad (1)$$

$$|VT1-VB2| > |VT1-VH2| \ldots \quad (2)$$

where the surface potential of the first toner image is VT1, the background potential in the second toner image forming process is VH2, and the developing bias in the second toner image forming process is VB2.

In the image forming method of the seventh embodiment, toner images of two types are not necessarily made of different colors and can include toner images composed of toner of the same color. For the developing steps carried out in the toner image formation processes A and B, either normal or reverse development may be adopted, so long as one is adopted in one image formation process and the other is adopted in the other image formation process If reverse development is adopted in first toner formation process A and normal development is adopted in second toner formation process B, it is possible to develop a sufficiently large contrast between the potential of each image area and the potential of the background to permit formation of an image of an adequate density.

An apparatus for practicing the above-described image forming method is shown in FIG. 31(*b*) by way of example and not as a limitation as comprising: latent image carrier 1001; first latent image forming means 1002 for forming a first latent image which corresponds to a first image and which is an object of one of normal development and reverse development on latent image carrier or holder 1001; a first developing means 1003 for developing the first latent image by a first toner charged to one polarity so as to form a first toner image; a second latent image forming means 1004 for forming a second latent image which corresponds to a second image and which is an object of the other one of reverse development and normal development on latent image carrier 1001 so that the second latent image has a background potential VH2 which is the intermediate potential of the potential of the image area of the second latent image and the surface potential VT1 of the first toner image; a second developing means 1005 to which a developing bias VB2 satisfying the relationship of $|VT1-VB2| > |VH2-VB2|$ and $|VT1-VB2| > |VT1-VH2|$ is applied and which develops the second latent image by a second toner charged to the other polarity by magnetic brush development so as to form a second toner image; and a transfer treatment means 1007 for simultaneously transferring the first and second toner images to a transfer medium 1007.

In the above means, any conventional material such as photosensitive material and dielectric material on which a latent image can be formed by latent image forming means 1002 and 1004 may be selected as a latent image holder 1001. The latent image holder may have either a drum-like structure or a belt-like structure.

The design of the first and second latent image forming means 1002 and 1004 may be changed so long as they are capable of forming latent images having a potential of a predetermined level on latent image holder 1001. For example, the latent image forming means may be designed so as to charge latent image carrier 1001 in advance and to statically eliminate charges at the position corresponding to the image or the non-image area, using light or ions, to a predetermined level, or to form a latent image of a predetermined level with ions without charging latent image carrier 1001 in advance. When forming a latent image with light, an optical write means such as an optical image formation system using a mirror and a lens system, a laser diode array, a light emitting diode array, a liquid crystal shutter array or a fluorescent indicator element array may be used. In the case of forming a latent image with ions, using a multistylus head or ion flow modulation head, a discharge head is appropriate.

For first and second developing means 1003 and 1005, a developer and a developing system may appropriately be selected, providing the first and second electrostatic latent images are reversely or normally developed with toners having opposite polarities. At least second developing means 1005 should be designed to adopt magnetic brush development. Developing bias VB2 should satisfy the above-described equations for effectively preventing the disturbance of the first toner image. Each developing means 1003 and 1005 may perform one developing function, but may be so designed as to have multiple developing functions for different colors and be capable of selectively switching the multiple functions.

Second developing means 1005 is preferably designed to reduce the frictional force with the first toner image. As one measure, a two component developer of the present invention, having a low density consisting of a predetermined color toner and a magnetic carrier having a density of not more than 4 g/cm$^3$ may be used, for the following reasons. To sufficiently reproduce the toner image density, it is generally necessary to carry a predetermined amount of developing agent to the developing nip portion of the second developing device. Therefore, it is necessary to set the value of TG/DRS (Trimming Gap divided by Drum Roll Space) in a range of from 0.7 to 1.2. However, in such a case, if the generally-used development agents having carriers with a density more than 4.0 g/cm$^3$ are used, the force of the second developing agent for scratching off the first developing agent becomes too large. As a result, although the second developing density can be made high, disturbance of the first image occurs By using a developing agent having a magnetic carrier with a density of not more than 4.0 g/cm$^3$, it is possible to make the second toner image density high without any disturbance of the first toner image. The density is preferably in a range of 1.7 to 4.0 g/cm$^3$, and more preferably in a range of 1.7 to 3.0 g/cm$^3$. In the case where the developing agent having a magnetic carrier with a density of not more than 4.0 g/cm$^3$ is used, the magnetic carrier may be appropriately selected from a porous carrier, a ferrite carrier, a carrier consisting of magnetic powder dispersed in a resin binder, etc. Of these, a carrier consisting of magnetic powder dispersed in a resin binder is preferred because the density can be easily adjusted by varying the content of the magnetic powder. As another measure, second developing means 1005 may be provided with a developer carrier or holder comprising a magnet roll fixed in a nonmagnetic rotary sleeve. By fixing a magnetic repulsion pole on the magnet roll corresponding to the developing nip range, as in the fourth embodiment, it is possible to adjust the magnetic brushing force against the developer in the developing nip range to be soft. As still another measure, second developing means 1005 may be provided with a developer holder comprising a magnet roll rotatably disposed in a nonmagnetic fixed sleeve. The moving speed of the developer on the developer holder is set to satisfy the relationship $0.5 \leqq V_{DEVE}/V_p \leqq 2.0$ where the moving speed of the developer on the developer holder is $V_{DEVE}$ and the rotational speed of latent image holder 1001 is $V_p$. This suppresses the impact force of the magnetic brush of the developer within a range which does not impair developing quality.

Transfer treatment means 1006 may be so designed as to have an electrostatic transfer system, a heat transfer system or the like, as desired, so long as it is capable of simultaneously transferring the first toner image and the second toner image to transfer means 1007. In regard to maintaining a good transferred state, an electrostatic transfer system may preferably be adopted. When an electrostatic transfer system is adopted, it is necessary to design transfer treatment means 1006 so that after a pretreatment of at least arranging the first and second toner images in the same polarity, transfer medium 1007 is charged to a polarity opposite to that of the toner images, and the toner images are electrostatically attracted to transfer medium 1007. In this case, in order to effectively restrain the toner which has adhered to the background portion on the surface of latent image holder 1001 which is called "fog toner," from being transferred to the transfer medium 1007, it is preferable, for example, to charge the fog toner to the polarity opposite to that of the toner at the image area, thereby transferring only the toner at the image area to transfer medium 1007.

The case will be described where the concept of the seventh embodiment of the present invention is applied to the image forming process wherein the first latent image Z1 is reversely developed in the first toner image formation process A and the second latent image Z2 is normally developed in the second toner image formation process B.

According to the seventh embodiment, as described above, in the first toner image formation process A, a first latent image Z1 which is the object of, for example, reverse development and which corresponds to a first image is formed on latent image carrier 1001 which has, for example, a positive charge characteristic. Then, first latent image Z1 is reversely developed by a first toner which is charged to a positive polarity so as to form a first toner image T1 having a surface potential of VT1, as shown in FIG. 32(*a*). Next, in the second toner image formation process B, a second latent image Z2 which is the object of normal development and which corresponds to a second image, is formed on latent image carrier 1001, and second latent image Z2 is then normally developed by a second toner which is charged to a negative polarity so as to form a second toner image T2, as shown in FIG. 32(*b*).

The background potential VH2 of the second latent image Z2 is now set to a potential intermediate to that of the surface potential VT1 of the first toner image T1 and that of the image area potential of the second latent image Z2. Since the surface potential VT1 of the first toner image T1 is lower than the background potential VH2, the portion of the first toner image T1 constitutes a form of potential well with respect to the ambient potential. A magnetic brush holding the second toner then brushes against the latent image carrier 1001 while a developing bias VB2 is applied. Since the developing bias VB2 is set to a larger value than the background potential VH2 of the second latent image Z2, the second toner is attracted to the second latent image Z2 without adhering to the first toner image portion T1 and the background portion H2 for the second latent image Z2.

The first toner and the second toner have polarities opposite to each other, so even if the second toner comes into contact with the first toner image T1 or the first toner is about to enter the second developer, both toners repel each other, thereby effectively avoiding the mixing of both toners.

When developing bias VB2 is being applied as shown in FIGS. 32(*b*) and (*c*), since the potential difference ΔVm of the first toner image T1 from the developing bias VB2 becomes larger than that of the ambient potential, an electrostatic field Sm at the portion corresponding to the first toner image T1 becomes larger than an electrostatic field S at the other portion. The electrostatic force Fm for pressing the first toner image A1 increases to that degree, as shown in FIGS. 32(*b*) and 32(*c*). In addition, on the peripheral portion of the first toner image T1, an electrostatic field Sn is formed in the direction indicated by the arrow in FIG. 32(*c*) on the basis of the potential difference ΔVn between the peripheral portion of the first toner image T1 and the background portion H2. An electrostatic force Fn which holds and constrains the first toner image Al in the horizontal direction is generated. As a result, the first toner image T1 is firmly retained on latent image holder 1001 by the electrostatic forces Fm and Fn, and even if the magnetic brush holding the second toner brushes against the first toner image, the disturbance of the first toner image A1 is effectively prevented. Thereafter, in transfer treatment process C, both toner images T1 and T2 on latent image holder 1001 are simultaneously transferred to transfer medium 1007.

In this image forming process, if the potential contrast between the first latent image Z1 and the second latent image Z2 is sufficiently large, it is possible to obtain a toner image having a sufficient density.

The above-described advantages obtained by the seventh embodiment will be discussed, in comparison with the case where the relationships ($|VT1-VB2|>|VH2-VB2|$, $|VT1-VB2|>|VT1-VH2|$) are not satisfied.

According to the method of the seventh embodiment in which the surface of a photosensitive material is uniformly charged, a negative image is first projected to reversely develop the statically eliminated portion of the photosensitive material which has been irradiated with light, using toner having the same polarity as that of the photosensitive material. A positive image is then projected to eliminate the charges at the residual charge portion on the surface of the photosensitive material, except the positive-image projected portion. The residual charge portion of the positive-image projected portion is then developed normally with toner having an opposite polarity to that of the photosensitive material, thereby forming negative and positive toner images on the same surface of the photosensitive material The negative and positive toner images are arranged in the same polarity, and the negative and positive toner images are transferred to a transfer medium simultaneously. If the above-described relationships ($|VT1-VB2|>|VH2-VB2|$, $|VT1-VB2|>|VT1-VH2|$) are not satisfied, the following disadvantages result.

In this type of image forming method, to eliminate the charges at the residual charge portion on the surface of the projected portion, the surface potential VT1 of a first toner image T1 substantially coincides with the potential VH2 of the background portion H2, except the second positive-image projected portion Z2. Or, rather, the surface potential VT1 of a first toner image T1 becomes slightly higher in the absolute value than the potential VH2 of the background portion H2 by the charges of the toner, as shown in FIG. 48(*a*). Therefore, an electrostatic field S0 directed toward the peripheral portion of the first toner image T1 is slightly applied between the peripheral portion of the first toner image T1 and the surface of the photosensitive material Z, as shown in FIG. 48(*b*).

In this state, if the second developing process is carried out by the developing system as described in Japanese Patent Laid-Open No. 137538/1980, the second developer is uniformly sprinkled over the surface portion of the photosensitive material containing the first toner image A1. The second developer therefore impinges on the first toner image T1 frequently and the first toner image is apt to be disadvantageously disturbed by the impact force as well as the action of field SO.

If, on the other hand, magnetic brush development is adopted for the second developing process, it is possible to positively attract the second toner to the second positive-image projected portion on the basis of the electrostatic field generated between the second positive-image projected portion and a developing roll. This results from applying an appropriate developing bias VB2 to the developing roll, as indicated by the chain line in FIG. 48(*a*). It is also possible to retain the first toner image T1 by the static attractive force F resulting from the electrostatic field Sa generated between the developing roll and the first toner image T1, as shown in FIG. 48(*c*). Accordingly, in comparison with cascade development, the disturbance of the first toner image due to scraping is reduced to a level corresponding to the existence of the electrostatic attractive force F. However, since the active force F0 caused by the electrostatic field S0 directing toward the peripheral portion of the first toner image T1 is applied, it is impossible to completely prevent disturbance of the first toner image T1.

The already-described advantages obtained by the seventh embodiment of the present invention are readily apparent from the above-description.

Next, the case will be described where the concept of the seventh embodiment of the present invention is applied to the image forming process wherein the first latent image Z1 is normally developed in the first toner image formation process A and the second latent image Z2 is reversely developed in the second toner image formation process B with reference to FIG. 33.

In the second toner image formation process, each of the potentials of the first toner image T1 (negative polarity, in this case), the second latent image Z2 and the background portion H2 thereof, and the developing bias VB2 are set in the relationship as shown in FIG. 33(*a*). The portion of the first toner image T1 constitutes a form of potential hill with respect to the ambient potential.

At this time, since the potential difference ΔVm of the first toner image T1 from the developing bias VB2 becomes larger than that of the ambient, an electrostatic field Sm at the portion corresponding to the first toner image T1 becomes larger than an electrostatic field S at the other portion, and the electrostatic force Fm for pressing the first toner image T1 having the negative polarity increases to that degree, as shown in FIG. 33(*b*). In addition, on the peripheral portion of the first toner image T1, an electrostatic field Sn is formed in the direction indicated by the arrow on the basis of the potential difference ΔVn between the peripheral portion of the first toner image T1 and the background portion H2, and an electrostatic force Fn is generated, which holds and constrains the first toner image T1 having the negative polarity in the horizontal direction. As a result, the first toner image T1 is firmly retained on latent image carrier 1001 by the electrostatic forces Fm and Fn, and even if the magnetic brush holding the second toner brushes against the first toner image T1, the disturbance of the first toner image T1 is effectively prevented.

The seventh embodiment will be explained in detail with reference to examples shown in the accompanying drawings.

EXAMPLE 1

A first example of a two-color printer to which an image forming method of the seventh embodiment is adapted is shown in FIG. 34 by way of example and not as a limitation as comprising positive charge type photosensitive drum 1010 as a latent image carrier having a photoconductive layer 1010*a* at a circumference portion thereof, charging corotron 1011 for charging photosensitive drum 1011 in advance, first LED array 1012 for forming a first latent image on drum 1011, first magnetic brush type developing unit 1013, using black toner which is positively charged, second LED array 1014 for forming a second latent image, second magnetic brush type developing unit 1015 using red toner which is negatively charged, pre-transfer corotron 1016 for arranging the charged toners on photosensitive drum 1010 in the same polarity before a transfer step, transfer corotron 1017 for charging a recording sheet 1018 to an opposite polarity to that of the toners adjusted by pre-transfer corotron 1016 and for electrostatically transferring the toner image of each color to recording sheet 1018, static elimination corotron 1019 for separating recording sheet 1018 from photosensitive drum 1010 after the transfer step, static elimination corotron 1020 for eliminating the residual charges on photosensitive drum 1010 and residual toner charges before a cleaning step, cleaner 1021 for removing the residual toner on photosensitive drum 1010, static eliminating lamp 1022 for completely eliminating the residual charges on photosensitive drum 1010 before the next image formation cycle, sheet supply tray 1023 accommodating recording sheet 1018, stabilizer 1024 for stabilizing the toner image on recording sheet 1018 which has passed through the transfer step, and guide plate 1025 for defining the route of travel of recording sheet 1018.

The operation of the image formation of the two color printer of this example will now be explained with reference to FIG. 34. An image consisting of a black image area (GB) and a red image area (GR) on a white ground (W) will be used as an example. The various areas of the example image are designated by the boxes along the top of FIG. 35.

Figure 35:
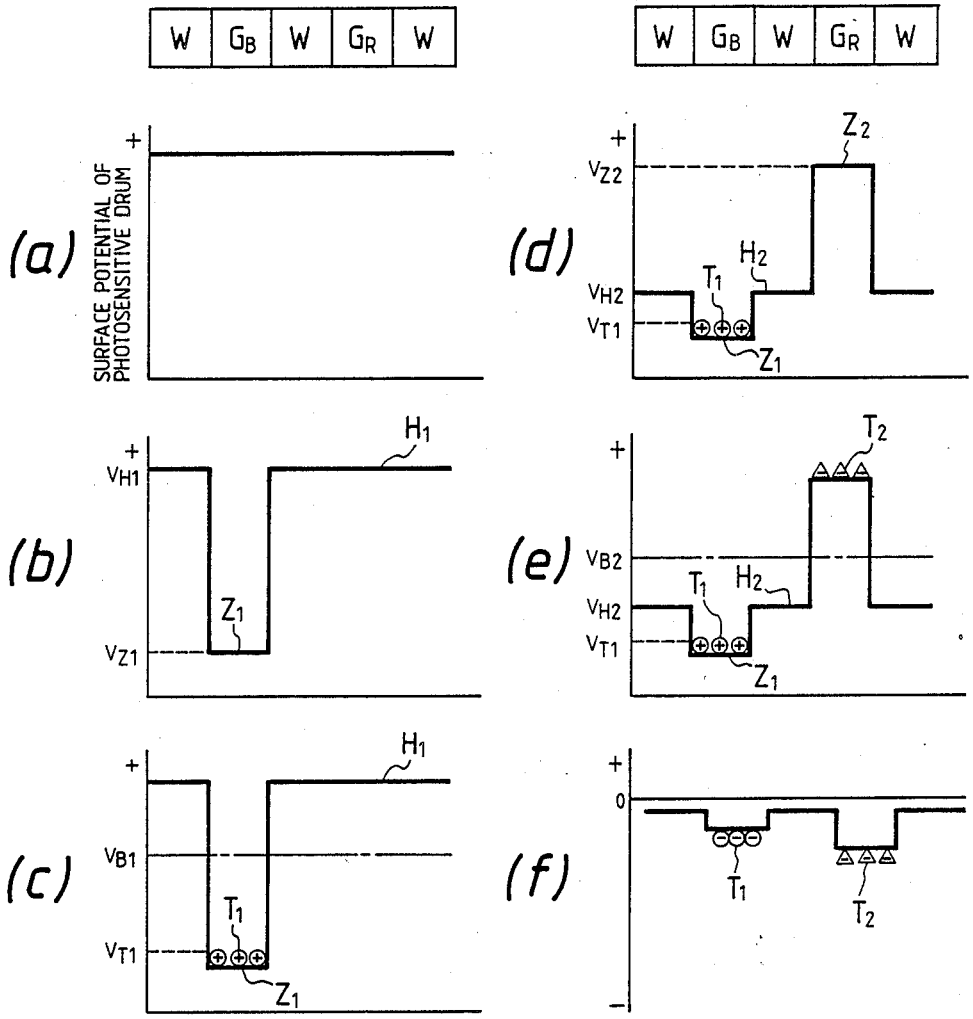

Photosensitive drum 1010 is first uniformly charged positively by charging corotron 1011 as shown by FIG. 35(*a*). The portion of the photosensitive drum which corresponds to the black image area (GB) is exposed by first LED array 1012 to obtain a negative image. The first latent image Z1 of photosensitive drum 1010 which corresponds to the black image area (GB) is now statically eliminated to a potential of VZ1, while the potentials of the portions of photosensitive drum 1010 which correspond to the white ground (W) and the red image area (GR) are maintained at the initial charged potential VH1 as shown by FIG. 35(*b*).

Next, the developing bias VB1 of first developing unit 1013 is set between the potential VZ1 of the first latent image Z1 and the initial charged potential VH1, and the first latent image Z1 is reversely developed by black toner positively charged by the first developing unit 1013 to form first toner image T1 as shown by FIG. 35(*c*).

The portion of photosensitive drum 1010 which corresponds to the red image area (GR) is exposed by second LED array 1014 to obtain a positive image. At this time, the potential of the second latent image Z2 of photosensitive drum 1010 which corresponds to the red image area (GR) is maintained at a potential VZ2 which is substantially equal to the initial charged potential VH1, while the background portion H2, except for the second image Z2, is statically eliminated so as to have a potential of VH2 higher than the surface potential VT1 of the first toner image T1 as shown by FIG. 35(*d*).

Next, the developing bias VB2 of second developing unit 1015 is set between the potential VZ2 of the second latent image Z2 and the background potential VH2, and the second latent image Z2 is normally developed by red toner negatively charged by second developing unit 1015 to form a second toner image T2 as shown by FIG. 35(*e*).

At this stage, the toner images T1 and T2 of the two colors have been formed on photosensitive drum 1010. After these toner images T1 and T2 are arranged in the same polarity, e.g., a negative polarity, by the pretransfer corotron 1016 as shown by FIG. 35(*f*), they are simultaneously transferred to recording sheet 1018 by transfer corotron 1017. After transfer, recording sheet 1018 is passed through stabilizer 1024 to stabilize the toner image of each color on recording sheet 1018.

At this time, almost no disturbance is observed in the images on recording sheet 1018, and the images have a good quality. It was confirmed on the basis of the results of the following experiment that the following equations must be satisfied in the second toner image formation process of the above-described operational process in order to obtain a good two-color image without disturbing the first toner image T1:

$$|VT1-VB2| > |VH2-VB2| \ldots \quad (1)$$

$$|VT1-VB2| > |VT1-VH2| \ldots \quad (2)$$

Experiments

Toner images were formed by stabilizing the conditions for the first toner image formation process and varying the parameters in the second toner image formation process. Disturbances of the first toner images T1 and the image densities based on the first and second toner images T1 and T2 were then measured.

In this case, the toner image to be measured was a line image of 300 μm extending in the axial direction (X) and the circumferential direction (Y) of photosensitive drum 1010. The disturbance was represented by the line width reproducibility which indicates the ratio of the line width of the reproduced toner image T1 on the assumption that the line width of the line image of a monochrome mode is 1, and by the coarseness indicating the degree of disturbance in the dimension at the edge portion of the reproduced toner image T1.

The conditions common to the experiments were as follows:

Photosensitive drum
- Se (selenium type photosensitive material (positive charge type)
- Drum diameter 200 mm Processing speed
- 160 mm/sec First Developer
- Two component type (black toner positively charged)
- Carrier
- Ferrite carrier having an average particle diameter of 100 μm
- Black toner
  - A mixture of 92 parts by weight of a styrene-n-butyl methacrylate copolymer, 8 parts by weight of Carbon Black #4000 (Trade Name, produced by Mitsubishi Chemical Industries, Co., Ltd.) and 2 parts by weight of charging controlling agent (Bontron P-51, Trade Name, produced by Orient Chemical Industries, Co. Ltd.) was melted, kneaded and pulverized to particles having an average particle diameter of 12 μm. The toner was positively charged with respect to the carrier.

Second developer
- Double-element (red toner negatively charged)
- Carrier A magnetic particle dispersion type carrier obtained by melting, kneading and pulverizing a mixture of 35 parts by weight of a styrene-n-butylmethacrylate copolymer and 65 parts by weight of magnetite. Avg. particle diameter: 30 μm. Density: 2.2 g/cm$^3$.
- Red toner
  - A mixture of 92 parts by weight of a styrene-n-butyl methacrylate copolymer, 8 parts by weight of a red pigment Lithor Scarlet (Trade Name, produced by BASF) and 2 parts by weight of charging controlling agent (E-84, Trade Name, produced by Orient Chemical Industries, Co. Ltd.) was melted, kneaded and pulverized to particles having an average particle diameter of 12 μm. The toner was negatively charged with respect to the carrier Parameters in the first developing unit
- Trimming gap (TG) 0.6 mm
- Drum Roll Space (DRS) [Space between the photosensitive drum and the developing roll]0.8 mm
- Magnet set angle (MGA) [Deviation angle of the set position of the main magnetic pole from the developing nip range]+5 degrees.
- Diameter and rotational speed of the developing sleeve: 50 mm, 480 mm/sec
- Amount of developer conveyed 60 mg/cm$^2$
- Type and magnetic force of main pole
- Propulsion magnetic pole, 750 Gauss Parameters in the second developing unit
- TG 0.6 mm
- DRS 0.8 mm
- MSA −5 degrees
- Diameter and rotational speed of the developing sleeve: 50 mm, 220 mm/sec
- Amount of developer conveyed 120 mg/cm$^3$
- Type and magnetic force of main pole Repulsion magnetic pole (magnetic poles of the same polarity disposed adjacently to each other), 1220 Gauss Voltage applied to pre-transfer corotron
- −5.0 KV DC Voltage applied to transfer corotron
- AC 400 Hz, Vp-p 8.5 KV, DC +2.5 KV When the first toner image was formed, the potential VZ1 of first latent image Z1 was fixed at 200 (V), the background potential VH1 of the first latent image Z1 was fixed at 800 (VV) and the first developing bias VB1 was fixed at 650 (V), as shown in FIG. 36(*a*). When the second toner image was formed 0.7 seconds after the formation of the first toner image, the surface potential VT2 of the second toner image, the second developing bias VB2, the background potential VH2 of the second latent image Z2, and the exposure E2 at the time of forming the second latent image, on the assumption that the exposure E1 at the time of forming the first latent image was 1, were varied to select the six Experimental Examples 1 to 6 shown in Table 2. When the second toner image was formed, the potentials VZ1 and VZ2 of the first and second latent images Z1 and Z2, respectively, and the surface potential VT1 of the first toner image Al were fixed at 160 (V), 700 (V) and 190 (V), respectively, with consideration for the dark decay.

The results of the characteristics of Experimental Examples 1 to 6 are shown in Table 3.

TABLE 2

| Experimental Example | 1 | 2 | 3 | 4 | 5 | 6 |
|---|---|---|---|---|---|---|
| VT2 | 680 | 670 | 660 | 660 | 660 | 660 |
| VB2 | 440 | 390 | 320 | 290 | 240 | 190 |
| VH2 | 340 | 290 | 220 | 190 | 140 | 90 |
| VT1 | 190 | 190 | 190 | 190 | 190 | 190 |
| E2 | 0.56 | 0.63 | 0.81 | 0.93 | 1.19 | 1.96 |
| \|VT1-VB2\| | 250 | 200 | 130 | 100 | 50 | 0 |
| \|VH2-VB2\| | 100 | 100 | 100 | 100 | 100 | 100 |
| \|VT1-VH2\| | 150 | 100 | 30 | 0 | 50 | 100 |
| Suitability | 0 | 0 | 0 | x | x | x |

In Table 2, the suitability means whether the conditions (1) ($|VT1-VB2|>|VH2-VB2|$) and (2) ($|VT1-VB2|>|VT1-VH2|$) are satisfied or not. If they are satisfied, the mark 0 is given, if not, the mark x is given.

TABLE 3

| Experimental Example | 1 | 2 | 3 | 4 | 5 | 6 |
|---|---|---|---|---|---|---|
| Line Width Reproducibility (X) | 1.07 | 1.14 | 1.20 | 1.30 | 1.40 | 1.50 |
| Reproduced line width (Y) | 1.10 | 1.17 | 1.20 | 1.30 | 1 .35 | 1.40 |
| Coarseness (X) | 6 | 7 | 8 | 10 | 15 | 20 |
| Coarseness (Y) | 5 | 6 | 8 | 11 | 14 | 20 |
| Density of first image | 1.60 | 1.60 | 1.60 | 1.60 | 1.50 | 1.45 |
| Density of second image | 0.90 | 1.05 | 1.20 | 1.20 | 1.20 | 1.20 |

In Table 3, the image characteristics of Examples 1 to 6 were graded in accordance with the standard shown in FIG. 37. It is empirically known that disturbance of the image is almost imperceptible if the line width reproducibility is less than 1.30 and the coarseness is less than 15 μm. Therefore, in evaluating the disturbance of the image, the range where the line width reproducibility is less than 1.30 and the coarseness is less than 15 μm was assumed to be a good range, grades G=0 to 1 were set in accordance with the degree of goodness, and if the measured values were out of the good range, grades G=1.5, 2, 3, and 4 were set in accordance with the degree of badness.

According to this grading, the images of Experimental Examples 1 to 3 (represent by P1 to P3 in FIG. 38) are in the good range, i.e., they, have a grade of 1 or less, and the images of Experimental Examples 4 to 6 (represented by P4 to P6 in FIG. 38) are in the bad range, i.e., they have grades exceeding 1.

When the degree to which the second toner was mixed with first toner image was examined, it was confirmed that no phenomenon of toner mixing was observed in Experimental Examples 1-3, a little phenomenon of toner mixing was observed in Experimental Example 4 and observed by eye in Experimental Examples 5 and 6.

EXAMPLE 2

A second example of a two-color copying machine to which the image forming method of the seventh preferred embodiment is shown in FIG. 39 by way of example and not as a limitation as comprising negative charge type photosensitive drum 1030 serving as a latent image carrier having a photoconductive layer 1030*a* on the periphery thereof, charging corotron 1031 for charging photosensitive drum 1030 in advance, LED array 1032 for forming a first latent image, optical image formation system 1033 for forming a second latent image which consists of an exposure lamp 1033*a* for irradiating an original 1035 on a platen 1034, a group of a plurality of mirrors 1033*b* for introducing the light reflected from the original 1035 to a predetermined position of photosensitive drum 1030 and an image formation lens 1033*c* for forming an optical image from the original 1035 onto the predetermined position of photosensitive drum 1030, first magnetic brush type developing unit 1036 using black toner which is negatively charged, second magnetic brush type developing unit 1037 using red toner which is positively charged, pretransfer corotron 1038 for arranging the charged toners on photosensitive drum 1030 in the same polarity before a transfer step, transfer corotron 1039 for transferring the toner image of each color to a copying sheet 1040, static elimination corotron 1041 for separating copying sheet 1040 from photosensitive drum 1030 after the transfer step, static elimination corotron 1042 for eliminating residual charges on photosensitive drum 1030 and residual toner charges before a cleaning step, cleaner 1043 for removing the residual toner on photosensitive drum 1030, static eliminating lamp 1044 for completely eliminating the residual charges on photosensitive drum 1030 before the next copying cycle, sheet supply tray 1045 accommodating copying sheet 1040, stabilizer 1046 for stabilizing the toner image on copying sheet 1040 on which the original image has been transferred and which has passed through the transferring step, a discharged sheet tray 1047 for receiving the discharged copied sheets which have passed through the stabilization step, and sheet conveying system 1048 for feeding copying sheet 1040 in sheet supply tray 1045 to a predetermined position for transfer at a predetermined time and conveying the sheet to discharge tray 1047 through stabilizer 1046.

In this example, second developing unit 1037 comprises a housing 1051 which accommodates a developing roll 1052, an agitator 1053 for agitating a developer, a conveying paddle 1054 for supplying the agitated developer g to developing roll 1052, a trimming bar 1055 for controlling the trimming gap of the developer g supplied to the periphery of developing roll 1052 and a mixing plate 1056 for returning the developer g scraped off by trimming bar 1055 to the side of agitator 1053, as shown in FIG. 40. Developing roll 1052 comprises a fixed sleeve 1057 of a nonmagnetic material, a magnet roll 1058 which has a multiplicity of propulsion magnetic poles 1058*a* and 1058*b* mounted therearound and which is disposed in fixed sleeve 1057 so as to be rotatable at a predetermined speed. In this case, if it is assumed that the rotational speed of photosensitive drum 1030 is Vp, and the moving speed of the developer g on developing roll 1052 is $V_{DEVE}$, the condition $0.5 \leqq V_{DEVE}/Vp \leqq 2.0$ is satisfied on the basis of the results of the later-described experiments.

The fundamental structure of first developing unit 1036 is substantially the same as second developing unit 1037. Unlike second developing unit 1037, developing roll 1052 of first developing unit 1036 is composed of a rotary sleeve 1059 and a magnet roll 1060 which has a multiplicity of propulsion magnetic poles 1060*a* and 1060*b* mounted therearound and which is fixed inside rotary sleeve 1059.

Figure 41:
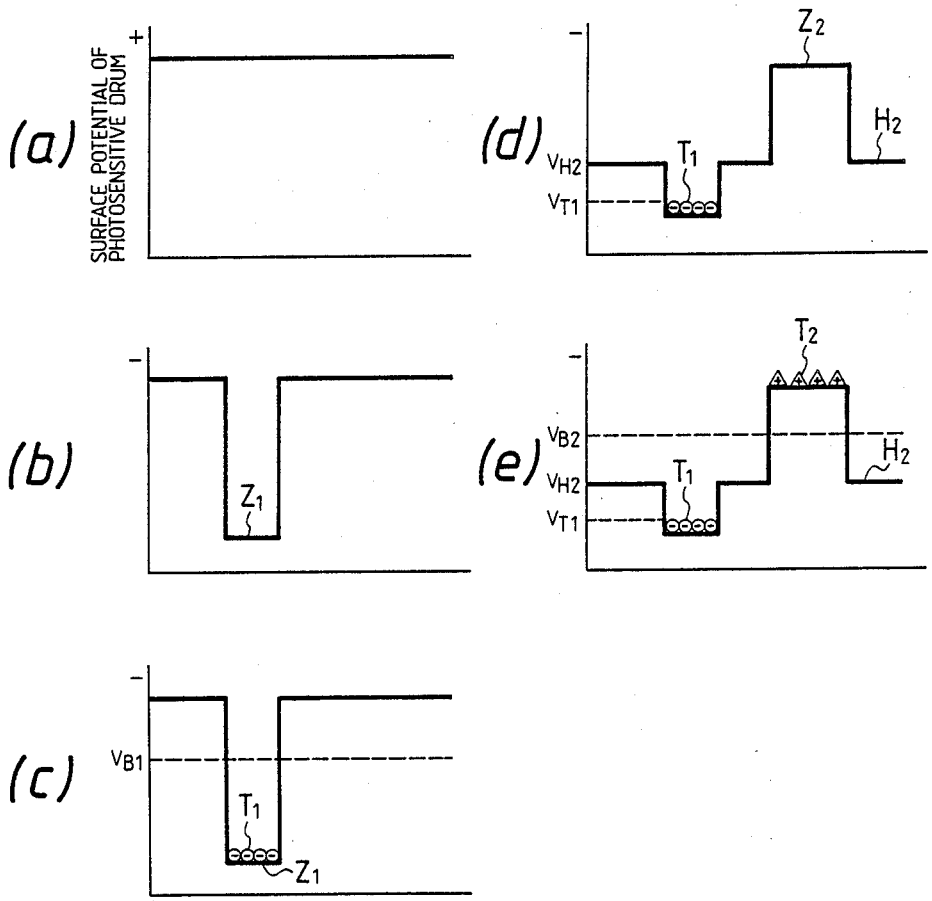

The operation of the two-color copying machine of this example will now be explained. The negative charge type photosensitive drum 1030 is first uniformly charged by charging corotron 1031 as shown by FIG. 41(*a*), and light is then projected by LED array 1032 in accordance with the image information to form first negative image Z1 on photosensitive drum 1030 as shown by FIG. 41(*b*). While an appropriate developing bias VB1 is applied to developing roll 1052 of first developing unit 1036, the first negative latent image Z1 is developed by negatively charged black toner to form the first toner image T1 as shown by FIG. 41(*c*). After the second positive latent image Z2 (the absolute value of the potential VH2 of the background H2 is larger than the absolute value of the surface potential VT1 of the first toner image T1) corresponding to the image of the original 1035 is formed on the photosensitive drum 1030 by the optical image forming system 1033 as shown by FIG. 41(*d*), the second positive latent image Z2 is developed by positively charged red toner to form the second toner image T2 while an appropriate developing bias VB2 is applied to the developing roll 1052 of second developing unit 1037 as shown by FIG. 41(*e*). Thereafter, the toners T1 and T2 on photosensitive drum 1030 are arranged in the same polarity by pretransfer corotron 1038 and the toner images T1 and T2 are transferred to copying sheet 1040 by transfer corotron 1039. The toner images T1 and T2 are stabilized through a predetermined stabilization step.

In the above-described operation process, contrary to the example, if a rotary sleeve 1057' and a fixed magnet roll 1058' are used as developing roll 1052 in the second developing step, as shown in FIG. 42(*b*), the group of developers g (carrier gc and toner gt) in the state of erecting on rotary sleeve 1057', i.e., in the state indicated by the solid line falls down to the state indicated by the broken line and rises again to the state indicated by the one-dot chain line. The group of developers g repeat this movement like an inchworm while moving in the direction k of movement of rotary sleeve 1057'. The frictional force between the developers g and photosensitive drum 1030 therefore becomes comparatively large. In this example, however, in the second developing procedure, magnet roll 1058 moves in the direction indicated by the arrow U1, as shown in FIG. 42(*a*), so that the group of the developers g (carrier gc and toner gt) in the state of erecting on fixed sleeve 1057, revolves in the direction indicated by the arrow U2 at a predetermined speed $V_{DEVE}$ while each developer rotates on its axis. The frictional force between the group of the developers g and photosensitive drum 1030 is restricted to a small force, thereby effectively preventing the disturbance of the first toner image T1.

In order to confirm the operational process described above, experiments for measuring the disturbance of the first toner image were carried out by varying the revolution number and the number of magnetic poles of magnet roll 1058 among the parameters of second developing unit 1037, while fixing the parameters of first developer 1036. The conditions common to the experiments were as follows:

Photosensitive drum
- Negative charge type organic semiconductor
- Moving speed 100 mm/sec First Developer
- Double-element type (black toner negatively charged) A mixture of 95 parts by weight of a carrier obtained by coating iron powder with a polymethyl methacrylate copolymer and having an average particle diameter of 100 μm and 5 parts by weight of a toner obtained by dispersing 7 parts by weight of carbon black in 93 parts by weight of a styrene-n-butyl methacrylate copolymer (copolymerization ration 80:20) and having an average particle diameter of 11 μm.

Second developer
- Two component type (red toner positively charged) A mixture of 90 parts by weight of a carrier obtained by mixing, melting, kneading and pulverizing a styrene-n-butyl methacrylate copolymer (density: 1.1 g/cm$^3$) and cubic type magnetite density: 4.8 g/cm$^3$) in the ratio of 35/65 and having a density of 2.2 g/cm$^3$ and an average particle diameter of 30 μm, and 10 parts by weight of a toner obtained by melting, kneading and pulverizing 92 parts by weight of a resin obtained by graft polymerization of a styrene-butyl-methacrylate copolymer with a low-molecular polyolefin and 8 parts by weight of a red pigment "Lithor Scarlet" (Trade Name: produced by BASF) and having an average particle diameter of 9.8 μm.

Potential conditions
- The first negative latent image Z1: −60 V
- The background portion of the first negative latent image Z1: −600 V
- The first developing bias VB1: −400 V
- The second positive latent image Z2: −580 V
- The background portion of the second positive latent image Z2: −200 V
- The second developing bias VB2: −300 V Parameters of the first developing unit
- Trimming gap: 0.6 mm
- Drum roll space: 0.8 mm
- Magnet set angle: +5°
- Diameter of the developing sleeve: 50 mm
- Structure of the magnet roll: Asymmetric 6 poles
- Magnetic force of the main pole: 750 Gauss Parameters of the second developing unit
- Trimming gap: 0.6 mm
- Drum roll space: 1.0 mm
  - Diameter of the developing sleeve: 50 mm
  - Magnetic force of the main pole: 800 Gauss Under these conditions, the number of poles of the second developing unit 1037 was changed to 8, 10 and 12 and the revolution number of the magnet roll 1058 was varied to 5, 10, 15, 25 and 30 (rps).

The first toner image was a horizontal line image 250 μm wide. When the ratio of the line width after conducting the second development process to the line width before conducting the second development process was within 1.1, the mark ◎ was given, when the ratio was within 1.2, the mark ○ was given. The mark x was given for all other cases. The results are shown in Table 4.

The experimental conditions represented by the ratio of the developer moving speed $V_{DEVE}$ and photosensitive drum 30 moving speed $V_p$ are shown in Table 5. In Table 5, if it is assumed that the diameter of the magnet roll is D (mm), the number of poles N, the revolution number of the magnet roll Rm (rps) and the erection length of the developer l (mm), $V_{DEVE}$ is approximately determined by the equation:

$$V_{DEVE}=(\pi D \times NlRM)/(\pi D-Nl)[mm/sec].$$

However, since the effective erection length is about 1 mm, it can be considered that $\pi D >> Nl$, so that $V_{DEVE}$ is approximately determined by the equation:

$$V_{DEVE}=NRm.$$

TABLE 4

| Revolution Number | Number of Poles 8 | 10 | 12 |
|---|---|---|---|
| 5 | x | ○ | ○ |
| 10 | ◎ | ◎ | ◎ |
| 15 | ◎ | ◎ | x |
| 20 | ○ | ○ | x |
| 25 | ○ | x | x |
| 30 | x | x | x |

TABLE 5

| Revolution Number | Number of Poles 8 | 10 | 12 |
|---|---|---|---|
| 5 | 0.4 | 0.5 | 0.6 |
| 10 | 0.8 | 1.0 | 1.2 |
| 15 | 1.2 | 1.5 | 1.8 |
| 20 | 1.6 | 2.0 | 2.4 |
| 25 | 2.0 | 2.5 | 3.0 |
| 30 | 2.4 | 3.0 | 3.6 |

Tables 4 and 5 assume that the speed ratio of the developer moving speed $V_{DEVE}$ with respect to the rotational speed Vp of the photosensitive drum is m. In order to make the deviation of the line width of the first tone image within a range of not more than 40%, which is the acceptable deviation of the first toner image, it is required that m satisfy the equation $0.5 \leqq m \leqq 2.0$. Furthermore, in order to make the deviation of the first toner image line width fall within a range not more than 20%, it is required that m satisfy the equation $0.8 \leqq m \leqq 1.5$.

EXAMPLE 3

A third example of a two-color printer incorporating the image forming method of the seventh embodiment is shown by FIG. 43, and comprises positive charge type photosensitive drum 1070 (Se type in this embodiment) serving as a latent image holder having a photoconductive layer 1070*a* on the periphery thereof, charging corotron 1071, first LED array 1072 for forming a first latent image, first magnetic brush type developing unit 1073, using black toner which is negatively charged, recharging corotron 1074 serving as a recharger for recharging photosensitive drum 1070, second LED array 1075 for forming a second latent image, second magnetic brush type developing unit 1076 using red toner which is positively charged, corotron 1077 for exposing and charging photosensitive drum 1070 simultaneously, transfer corotron 1078, roll type recording sheet roll 1079, guide roll 1080 for recording sheet 1079, static elimination corotron 1081, cleaner 1082 and static eliminating lamp 1083.

In this example, exposing and charging corotron 1077 discharges photoconductive layer 1070*a* of photosensitive drum 1070 by applying an AC voltage to corotron 1077 on which a DC voltage having the same polarity as photosensitive layer 1070*a* is superposed, while uniformly exposing photoconductive layer 1070*a*.

An example of the discharging characteristic is shown in FIG. 44. In FIG. 44, the ordinate represents the current I flowing to the surface of the photoconductive layer by the discharging treatment, and the abscissa represents the surface potential VPR of photoconductive layer 1070*a*. V0 represents the surface potential of photoconductive layer 1070*a* when I=0. In discharging photoconductive layer 1070*a*, the potential V0 is set to a higher absolute value than the background potential.

Figure 45:
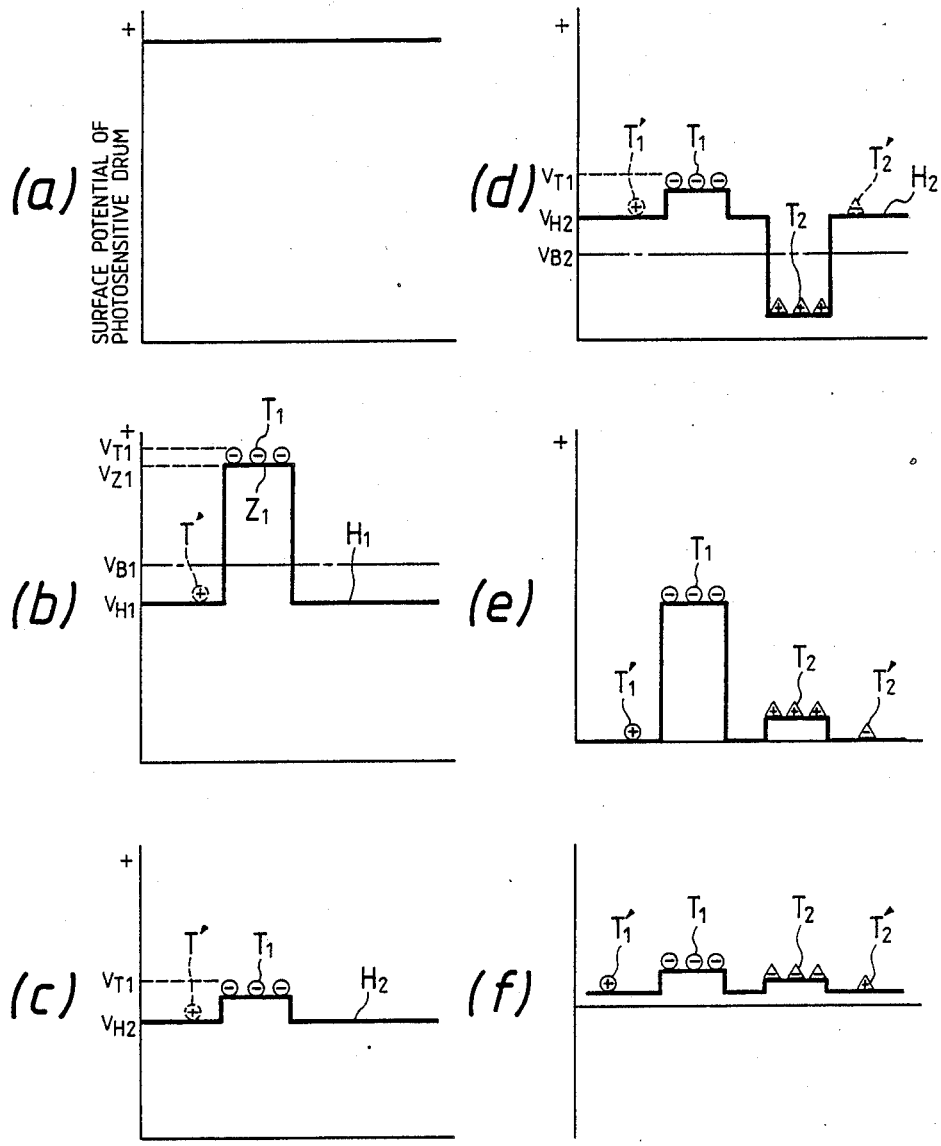

The operation of the two-color printer of this example will now be explained. Photoconductive layer 1070*a* of photosensitive drum 1070, which was rotating in the direction indicated by the arrow, was first uniformly charged to +1300 V by charging corotron 1071, as shown by FIG. 45(*a*). The portion of photosensitive drum 1070 corresponding to the first image is exposed by first LED array 1072 to obtain a positive latent image Z1 on photoconductive layer 1070*a*, as shown by FIG. 45(*b*). The potential VZ1 of the first latent image Z1 after the exposure was +1200 V and the potential VH1 of the background portion H1 is +650 V.

Next, under a developing bias VB1 of +800 V, the first latent image Z1 is normally developed by black toner negatively charged by first developing unit 1073 to form a first toner image T1, as shown by FIG. 45(*b*). The symbol T' represents a first fog toner which adheres to the background portion. Photoconductive layer 1070*a* is charged again by recharging corotron 1074 so that the potential VT1 of the first toner image T1 is +600 V and the background potential VH2 is +500 V, as shown by FIG. 45(*c*). The portion of the photosensitive drum 1070 which corresponds to the second image was exposed by the second LED array 1075 to form a negative latent image Z2 (FIG. 45(*d*)). The potential VZ2 of the second latent image Z2 after exposure is +100 V.

Under a developing bias VB2 of +350 V, the second latent image Z2 is now reversely developed by the positively charged red toner by second developing unit 1076 to form a second toner image T2, as shown by FIG. 45(*d*). The symbol T2' represents a second fog toner which adheres to the background portion.

Photoconductive layer 1070*a* is next subjected to discharging treatment under uniform exposure by exposing and charging corotron 1077. In this case, the background portion of photoconductive layer 1070*a*, having no toner images T1 and T2 thereon, is made photoconductive by the uniform exposure. However, at the T1 and T2 portions of the toner image, since light is cut off by the toners, the photoconductive layer 1070*a* at those portions does not become photoconductive, so that the surface potential at the positions of the toner images T1 and T2 is kept higher than the background potential, as shown by FIG. 45(*e*). The discharging treatment was carried out by applying an AC voltage to corotron 1077 on which is superposed a positive polarity DC voltage which is the same as that of photoconductive layer 1070*a*. When the absolute value of V0 is set to a slightly higher value (about 50 V) than the background potential, the first and second toner images T1 and T2 at the image area are negatively charged, while the fog toners T1' and T2' at the background portion are positively charged, as shown by FIG. 45(*f*).

Toner images T1 and T2 are then transferred by transfer corotron 1078 to which a DC voltage having the opposite polarity to that of the toner at the image area is applied. As a result, the toner images T1 and T2 alone, which are negatively polarized, are transferred to recording sheet 1079, resulting in a good red and black image without fog.

Additionally, in this embodiment, if the DC voltage applied to exposing and charging corotron 1077 is variable, it is possible to vary V0 to correct for potential changes as a result of environmental effects, thus maintaining good two-image color quality independent of environmental changes.

EXAMPLE 4

A fourth example of a two-color printer incorporating the image forming method of the seventh embodiment is shown by FIG. 46. The fundamental structure is substantially the same as that of the above-described Example 3. Unlike the Example 3, recharging corotron 1074 is not used, and in place of exposing and discharging corotron 1077, a pretransfer exposure lamp 1091 and a pre-transfer charging corotron 1092 which are functionally separated from each other are used. The same numerals are provided for the elements which are the same as those in the Example 3, and explanation thereof will be omitted.

In this example, in the first latent image formation process, first LED array 1072 exposes to obtain a negative image corresponding to the first image, and in the second latent image formation process, second LED array 1075 exposes to obtain a positive image corresponding to the second image. First developing unit 1073 carries positively charged black toner, while second developing unit 1076 carries negatively charged red toner.

Figure 47:
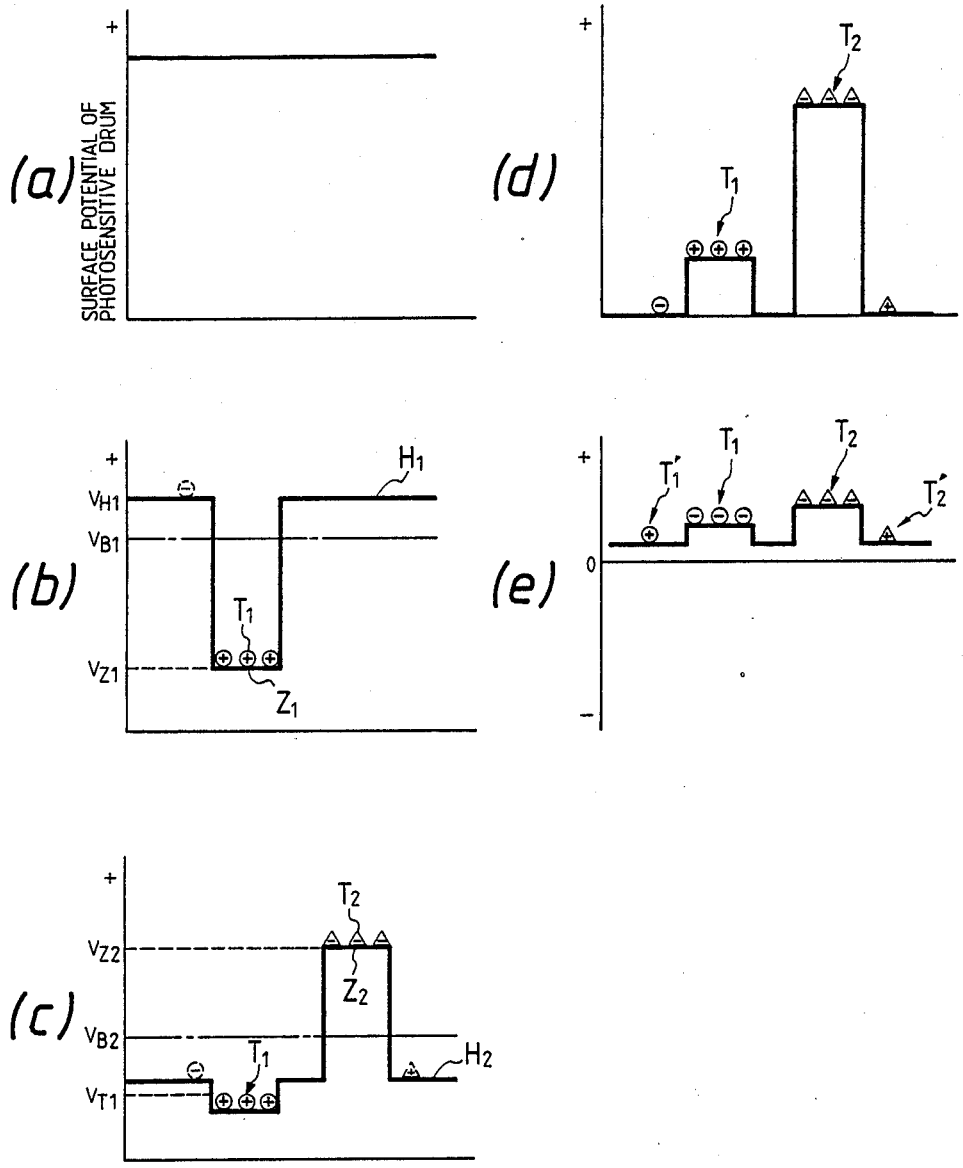

The operation of the two-color printer of the fourth example will now be explained with reference to FIG. 46. Photoconductive layer 1070*a* of photosensitive drum 1070 is first uniformly charged to +1000 V by charging corotron 1071, as shown by FIG. 47(*a*). The portion of photosensitive drum 1070 which corresponds to the first image is exposed by first LED array 1072 to obtain a negative latent image Z1 on photoconductive layer 1070*a*, as shown by FIG. 47(*b*). The potential VZ1 of the first latent image Z1 after the exposure is +250 V and the potential VH1 of the background portion H1 is +900 V.

Under developing bias VB1 of +750 V, the first latent image Z1 is reversely developed by positively charged black toner by first developing unit 1073 to form a first toner image T1, as shown by FIG. 47(*b*). The symbol T1' represents a first fog toner which adheres to the background portion. The portion of photosensitive drum 1070 which corresponded to the second image is exposed by second LED array 1075 to form a positive latent image Z2, as shown by FIG. 47(*c*). The potential VZ2 of the second latent image Z2 after the exposure is +800 V, the background potential VH2 is 300 V, and the surface potential VT1 of the first toner image T1 is 200 V.

Thereafter, under a developing bias VB2 of +450 V, the second latent image Z2 is normally developed by negatively charged red toner by second developing unit 1076 to form a second toner image T2, as shown by FIG. 47(*c*). The symbol T2' represents a second fog toner which adheres to the background portion. Photoconductive layer 1070*a* was next subjected to discharging treatment by the uniform exposure by pre-transfer exposure lamp 1091, as shown by FIG. 47(*d*). Photoconductive layer 1070*a* was next subjected to discharging treatment by pre-transfer charging corotron 1092. In this case, by substantially the same action as that in the Example 3, the first and second toner images T1 and T2 at the image area are negatively charged, while the fog toners T1' and T2' at the background portion are positively charged, as shown by FIG. 47(*e*).

The toner images T1 and T2 are then transferred by transfer corotron 1078 to which a DC voltage having the opposite polarity to that of the toner at the image area is applied. As a result, the toner images T1 and T2 alone which have been arranged in the negative polarity are transferred to recording sheet 1079, thereby obtaining a good red and black image without fog.

As has been explained above, according to a method of and an apparatus for forming an image of the seventh embodiment, since toners having the opposite polarities are used to form toner images of two types, and a force for preventing the disturbance of the first toner images is provided in the second toner image formation process, it is possible to produce a good image formation process. It is also possible to form a good image based on the toner images of two types while effectively preventing the two types of toners from mixing and the first toner image from being disturbed.

According to a method of forming an image in the seventh embodiment, it is possible to form two types of images with good efficiency when using a photosensitive material as a latent image holder or carrier. In particular, when the first image is reversely developed and the second image is normally developed, if the photosensitive material is initially charged, it is possible for the contrast between the first and second latent images to be sufficiently large without the need for recharging in the middle of processing. This results in the formation of an image having a sufficient density.

According to the image forming apparatus of Example 2, since the constraining force of the magnetic brush with respect to the developer holder in the second developing means is weakened in the developing nip range on the basis of the field of a repulsion magnetic pole, the frictional force between the magnetic brush and the latent image holder in the developing nip range is suppressed, and the disturbance of the first toner image is safely prevented.

Furthermore, in the image forming apparatus of Example 2, since the second developing means suppresses the frictional force between the magnetic brush and the latent image holder in a range which maintains developing capacity, it is possible to safely prevent disturbance of the first toner image without impairing the state of the formation of the second toner image.

According to an image forming apparatus of the seventh embodiment, an electrostatic transfer system permits the transfer of toner images having different polarities to a transfer medium with good efficiency. In this case, particularly in Examples 3 and 4, it is possible to transfer the toner at the image area alone by making the polarities of the toner at the image area and the toner at the background portion different from each other. This results in formation of a good image without any fog. In particular, when an AC voltage, having a superposed DC component with the same polarity as the charged polarity of the latent image carrier, is applied to the charging means, it is possible to effectively make the polarities of the toner at the image area and the toner at the background portion different from each other.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of applicants' general inventive concept.

What is claimed is:

1. An image forming method comprising:

forming a first toner image by forming, on a latent image carrier, a first latent image corresponding to a first image, and by developing said first latent image, using a first toner charged to a first polarity, with a development process selected from normal and reverse development processes chosen to correspond to the polarity of said first toner;

forming a second toner image by forming, on a latent image carrier, a second latent image corresponding to a second image, and by developing said second latent image, using a second toner charged to a second polarity opposite to said first polarity, with a development process selected from normal and reverse development processes chosen to correspond to the polarity of said second toner, while applying a developing bias VB2;

simultaneously transferring said first and second toner images to a transfer medium during a transfer treatment process; and wherein said developing bias VB2 satisfies the following equations:

$$|VT1-VB2|>|VH2-VB2| \ldots \quad (1)$$

$$|VT1-VB2|>|VT1-VH2| \ldots \quad (2),$$

wherein a surface potential of said first toner image in said step of forming a second toner image is VT1, a background potential in said step of forming a second toner image is VH2, and a developing bias in said step of forming a second toner image is VB2.

2. The image forming method of claim 1, wherein;

said step of forming a first toner image includes uniformly charging a photosensitive material of a latent image carrier, exposing a first image area to light so as to obtain a first negative image and reversely developing said exposed portion using a first toner which is charged to the same polarity as the charged polarity of the photosensitive material;

said step of forming a second toner image includes exposing a background portion, except a second image area, to light at a level weaker than a first exposure level so as to obtain a second positive image, and normally developing an unexposed portion by a second toner which is charged to a polarity different from said photosensitive material; and simultaneously transferring said first and second toner images to said transfer medium.

3. The image forming method of claim 1, wherein;

said step of forming a first toner image includes uniformly charging a photosensitive material of said latent image holder, exposing an area outside a first image area to light to obtain a first positive image, and normally developing an unexposed portion using a first toner which is charged to a polarity opposite to the charged polarity of said photosensitive material;

said step of forming a second toner image is formed by recharging said photosensitive material to a lower level in absolute value than the potential of said first toner image without changing the polarity of said first toner image, exposing a second image and reversely developing said exposed portion of said second image by a second toner which is charged to the same polarity as the charged polarity of said photosensitive material; and simultaneously transferring said first and second toner images to said transfer medium.

4. An image forming apparatus comprising:

a latent image carrier;

a first latent image forming means for forming a first latent image corresponding to a first image and which is an object of one selected from normal development and reverse development on said latent image holder;

a first developing means for developing said first latent image by a first toner charged to one polarity so as to form a first toner image;

a second latent image forming means for forming a second latent image corresponding to a second image and which is an object of another selected from reverse development and normal development on said latent image holder so that said second latent image has a background potential VH2 which is the intermediate potential of the potential of the image area of said second latent image and the surface potential VT1 of said first toner image;

a second developing means to which a developing bias VB2 satisfying the equations $|VT1-VB2|>|VH1-VB2|$ and $|VT1-VB2|>|VT1-VH2|$ is applied and which develops said second latent image by a second toner charged to a second polarity by magnetic brush development so as to form a second toner image; and a transfer treatment means for simultaneously transferring said first and second toner images to a transfer medium.

5. The image forming apparatus according of claim 4, wherein said second developing means includes a developer holder comprising a nonmagnetic rotary sleeve with a magnet roll fixed therein, said magnet roll having a repulsion magnetic pole in correspondence with a developing nip range.

6. The image forming apparatus of claim 4, wherein said second developing means includes a developer holder comprising a nonmagnetic fixed sleeve with a magnet roll rotatably disposed therein so as to satisfy the equation:

$$0.5 \leqq V_{DEVE}/Vp \leqq 2.0$$

where the moving speed of said developer is $V_{DEVE}$ and the rotational speed of said latent image carrier is Vp.

7. The image forming apparatus of claim 4, wherein said transfer treatment means includes:

a pre-transfer treatment means for arranging said first and second toner images in the same polarity; and a transfer means for charging said transfer medium to a polarity opposite to the charged polarity of said toner images arranged by said pre-transfer treatment means, and for electrostatically transferring said toner images to said transfer medium.

8. The image forming apparatus of claim 7, wherein said pre-transfer treatment means includes:

a uniform exposure means for uniformly exposing the surface of a photosensitive material of said latent image holder; and a charging means for discharging during or after exposure by said uniform exposure means.

9. The image forming apparatus of claim 7, wherein an AC voltage to which is superposed a DC component having the same polarity as the charged polarity of said latent image holder is applied to said charging means.

* * * * *

UNITED STATES PATENT AND TRADEMARK OFFICE

CERTIFICATE OF CORRECTION

PATENT NO. : 4,937,629

DATED : June 26, 1990

INVENTOR(S) : Kazuo Maruyama, et. al.

It is certified that error appears in the above-identified patent and that said Letters Patent is hereby corrected as shown below:

Title page, Inventor's name, change "Tsuneo Naomi" to --Tsuneo Noami--;

Title page, Priority Data, change "62-8628" to --62-88628--;

Signed and Sealed this

Twenty-ninth Day of December, 1992

*Attest:*

DOUGLAS B. COMER

*Attesting Officer*

*Acting Commissioner of Patents and Trademarks*